US005709162A

United States Patent [19]

Pagett et al.

[11] Patent Number: 5,709,162

[45] Date of Patent: Jan. 20, 1998

[54] SEMI-AUTOMATIC METHOD TO ATTACH CIRCULAR COLLARS TO T-SHIRTS

[75] Inventors: Stephen J. Pagett; Maxmilian Adamski, Jr., both of Tega Cay, S.C.; Richard J. Kurtz; Conrad L. Fernandez, both of Charlotte, N.C.

[73] Assignee: Union Special Corporation, Huntley, Ill.

[21] Appl. No.: 722,509

[22] Filed: Sep. 27, 1996

Related U.S. Application Data

[63] Continuation-in-part of Ser. No. 311,504, Sep. 23, 1994, Pat. No. 5,570,647.

[51] Int. Cl.[6] ..... D05B 21/00; D05B 27/10; D05B 35/10

[52] U.S. Cl. ..... 112/470.07; 112/63; 112/153; 112/305; 112/306; 112/475.03

[58] Field of Search ..... 112/470.07, 470.31, 112/63, 153, 305, 306, 318, 322, 475.03, 475.04, 475.09

[56] References Cited

U.S. PATENT DOCUMENTS

| | | | |
|---|---|---|---|
| 3,736,895 | 6/1973 | Farrar et al. | 112/153 X |
| 4,159,687 | 7/1979 | Masuda et al. . | |
| 4,467,734 | 8/1984 | Rohr . | |
| 4,467,739 | 8/1984 | Hager et al. . | |
| 4,479,447 | 10/1984 | Rohr . | |
| 4,512,268 | 4/1985 | Rohr . | |
| 4,665,848 | 5/1987 | Michaels et al. . | |
| 4,681,051 | 7/1987 | Kirch et al. . | |
| 4,682,553 | 7/1987 | Bachmann et al. . | |
| 4,714,036 | 12/1987 | Raisin et al. . | |
| 4,744,319 | 5/1988 | Rohr . | |
| 4,823,716 | 4/1989 | Nakashima . | |
| 4,827,856 | 5/1989 | Rohr . | |
| 4,827,858 | 5/1989 | Horie et al. . | |
| 4,836,119 | 6/1989 | Siraco et al. . | |
| 4,883,005 | 11/1989 | Wehmeyer . | |
| 4,998,493 | 3/1991 | Tanaka . | |
| 5,029,541 | 7/1991 | Rohr et al. . | |
| 5,103,749 | 4/1992 | Geisselmann et al. . | |
| 5,188,047 | 2/1993 | Rohr et al. . | |
| 5,251,557 | 10/1993 | Rohr . | |
| 5,269,239 | 12/1993 | Adamski et al. . | |
| 5,269,257 | 12/1993 | Yamazaki . | |
| 5,271,347 | 12/1993 | Fontcuberta | 112/475.03 |
| 5,370,072 | 12/1994 | Adamski . | |
| 5,570,647 | 11/1996 | Adamski, Jr. et al. | 112/63 X |
| 5,622,125 | 4/1997 | Adamski, Jr. et al. | 112/470.07 X |

FOREIGN PATENT DOCUMENTS

| | | |
|---|---|---|
| 62-94195 | 4/1987 | Japan . |
| 2249686 | 10/1987 | Japan . |

*Primary Examiner*—Peter Nerbun
*Attorney, Agent, or Firm*—Brinks Hofer Gilson & Lione

[57] ABSTRACT

A sewing machine in combination with a workpiece control and advancing mechanism for automatically forming a seam along the aligned edges of a two ply waist band and a shirt body. The mechanism includes edge guiders, that are controlled by sensors, for individually controlling each workpiece edge such that the marginal edges of all layers are aligned.

17 Claims, 18 Drawing Sheets

POWER UP SEQUENCE

LOAD SEQUENCE

SEW SEQUENCE

STACK SEQUENCE

SEMI-AUTOMATIC METHOD TO ATTACH CIRCULAR COLLARS TO T-SHIRTS

CROSS-REFERENCES

The present application is a continuation in part of application Ser. No. 08/311,504 filed Sep. 23, 1994, entitled "AUTOMATIC ATTACHMENT OF A RIB KNIT BAND TO A SHIRT BODY", now U.S. Pat. No. 5,570,647.

BACKGROUND OF THE INVENTION

This invention relates to a machine and method for semi-automatically attaching a circular collar to the neck opening of a shirt body and more particularity this invention relates to attaching the collar band to T-shirts and sweat shirts. The invention can also be used to attach waistbands to very small fleece sweat shirts or to attach various banding material to any near circular opening.

This operation is currently performed by an operator using a sewing machine combined with some rollers to assist in handling the material to be sewn. The operator must control the three material edges and maintain proper tension on the T-shirt fabric through the entire sewing cycle. The operator must also monitor and control the trim, tension and oversew on the garment each of which requires a high level of skill and training. Unless this operation is performed by a highly skilled operator the finished garment will not look smooth and uniform around the collar area. Furthermore, this operation requires some hand, arm and wrist motions that can contribute to operator injury. This manual method is slow, expensive, wasteful of material, has a high rate of unacceptable products and places the operator under ergonomic stress and strain which is very fatiguing.

A method has been developed by Atlanta Attachment Company, in which the waist band and the shirt are loaded on rollers that can be pneumatically expanded. The garment pieces are automatically guided during the sewing cycle. Stitch counting from the beginning of the cycle is relied upon to signal when the garment is completed, after which the finished garment is automatically stacked. However, this method does not provide for individual material edge guidance and thus a relatively large edge ribbon of unequal width must be trimmed to assure that all edges will be stitched. In addition to wasting material this results in a waist band of unequal width and a finished product that does not have equal lengths around its periphery. Also in a method such as this, that relies upon stitch counting from the beginning of the cycle to signal when the garment is completed, a margin of error must be applied to the stitch count that will result in over-stitching of the beginning seam in most products. Furthermore there is no assurance that the edge guiders are actually functioning or that they are operating at a speed or feed that is synchronized with the sewing machine speed or feed.

The above identified pending application Ser. No. 08/311,504 was designed for and is intended for attaching large bands of material, such as waist bands to a sweat shirt body. The size of the material used in that process are not only larger but also are thicker than used in the neck band process. As a result for the machine disclosed in application Ser. No. 08/311,504 each layer of the material being joined together was provided with its own edge guide device and sensors. As a result of this abundance of accessories, each of which occupies a given space, that machine cannot perform its function with projects as small as the neck band for T-shirts. Furthermore, the components used on that machine, which are necessary to perform as intended, have high initial and maintenance cost.

For the foregoing reasons, there is a need for a semi-automatic machine for attaching neck bands to the neck openings of T-shirt body that will permit the operator to load the neck band and shirt body on the machine after which the remaining operation of guiding, trimming, tensioning the garment and discharging the finished product are performed automatically.

There is also a need for an automatic machine for attaching waist bands to the bottom edge of a shirt that independently guides each material edge and relies upon a method that senses the approach of the beginning seam as a signal from which completion of the garment is calculated. There is also a need for a machine of this type that has the ability to monitor the edge guiders to assure the operator that they are functioning and to synchronize the edge guiders speed and feed with the sewing machines such that waist bands having uniform width and garments having uniform length are produced.

SUMMARY OF THE INVENTION

The present invention is directed to a machine and method that satisfies these needs. The apparatus comprises a sewing machine for automatically, forming a seam along the aligned edges of a plurality of layers of tubular work pieces. A single edge guide device functions to control the edge of the shirt body and marginal edges of the neck band are controlled by the workpiece control rollers. This is accomplished by providing a groove in the rollers that receive the folded neck band over which the shirt body fabric is placed. The edge guider engages the upper surface of the shirt body material maintaining alignment of the sheet body edge with the pair of edges of the neck band. This has the additional advantage of minimizing the trimming of the neck band edges. This relatively narrow band of material is very visible and if it is not of uniform width it is apparent and results in the finished product to a low quality.

The apparatus also comprises a sewing machine for automatically forming a seam along the aligned edges of a plurality of layers of tubular workpieces. Mechanism for individually controlling each workpiece edge such that the marginal edges of all layers are aligned. The mechanism for individually controlling each workpiece edge thus functions to insure that the stitch line will be a predetermined distance from the aligned marginal edges of the workpieces. This has the additional advantage of it minimizing the width of the edge ribbon that must be trimmed to assure that the stitch is properly located relative to each individual edge, produces waist bands having uniform width and finished garments having uniform lengths. The apparatus of this invention includes a guide member and a tension roller that support the tubular workpieces and can be programmed by the machines processor to accommodated workpieces of various sizes and styles. The tensioning roller is programmed such that tubular workpieces can be loaded in a relaxed state and then stretched to a predetermined expanded state when said tension roller is moved away from the guide member. A seam sensing device and mechanism for retracting the edge guide members from the stitch line as the seam approaches the sewing area is provided for completing the stitching cycle. The apparatus is controlled by a microprocessor that receives and sends signals that start and end the seaming cycle as well as open, close, extend and retract the edge guider members at the appropriate time.

The present invention permits the waist band to be loaded in a relaxed state thus relieving the operator from the task of stretching it over the conveyor system. Also the shirt can be loaded while it is in a relaxed state that is only slightly expanded from the state that the band was loaded. These features permit the operator to easily and quickly load a waist band and shirt body on the sewing machine with little physical effort. Since both edges of the folded waist band are individually guided it is not necessary to overload the waist band and then trim off excessive amounts of the edges in order to assure proper closing of the seam. This is extremely important because of the high cost of materials from which waist bands are constructed.

For the foregoing reasons there is a need for a machine that minimizes the time required, the stress placed on an operator and the material wasted when connecting a waist band to a shirt body.

DETAILED DESCRIPTION OF THE PREFERRED EMBODIMENT

Figure 1:
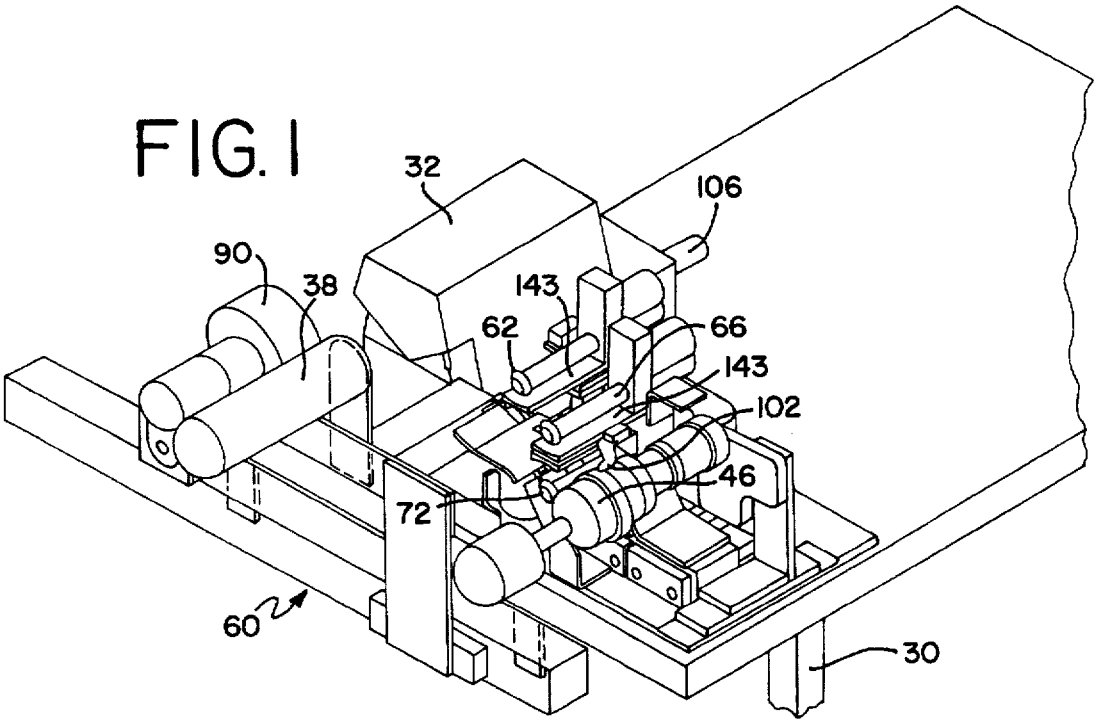
FIG. 1 is a perspective view of the machine of this invention.

With reference to FIGS. 1 through 9 the sewing machine 32, workpiece control and advancing mechanism 60 and the workpiece that this invention produces will be described. The sewing machine 32 and workpiece control and advancing mechanism 60 are controlled by a microprocessor controller 50 that monitors and synchronizes components and sends signals that activate component at precise times in the sewing cycle. During this pre-sew pull alignment the microprocessor controller 50 monitors the edge guider sensors 10, 67 and 73 to determine if the three fabric edges are being controlled. In addition to guiding the workpiece edges the microprocessor controller 50 monitors the edge guider sensors 10, 67 and 73 to determine if the edges of the material are being controlled. If there are no transitions in signal levels within a certain time period during any of the pre-sew pull alignment functions or in stitch counts during the sewing cycle, the microprocessor controller 50 will stop the operation and send a signal to the operator to resolve the problem.

Figure 3:
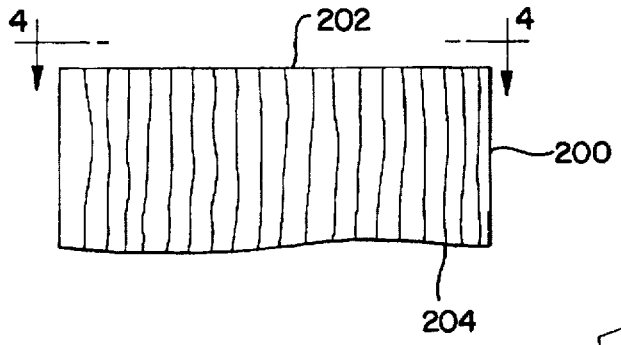
FIG. 3 is a top view of an unfolded ribbed waist band.
Figure 7:
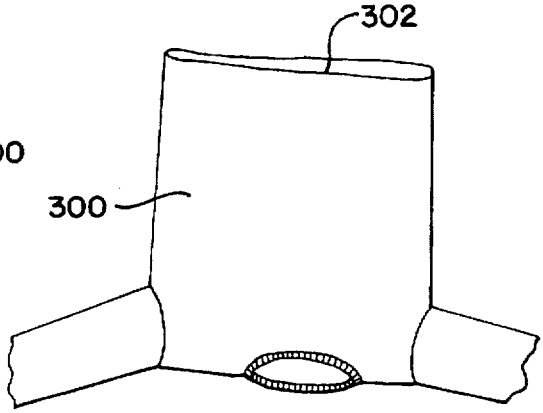
FIG. 7 is a top view of a shirt body before a ribbed waist band was added.
Figure 4:
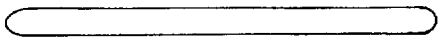
FIG. 4 is an end view of the unfolded ribbed waist band seen in FIG. 3 taken along lines 4—4 of FIG. 3.
Figure 5:
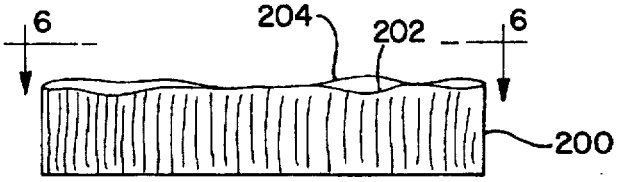
FIG. 5 is a top view of a ribbed waist band that has been folded over such that its two longitudinal edges are aligned.
Figure 6:
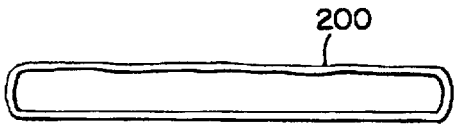
FIG. 6 is an end view of the folded ribbed waist band taken along lines 6—6 of FIG. 5.

This invention automates the process of connecting a waist band 200 to the lower edge of a shirt body 300. As best seen in FIGS. 3 and 4 the waist band 200 is in the shape of a uniform width tube having edges 202 and 204, and in the preferred embodiment is made of a ribbed or spandek material that is stretchable. As best seen in FIGS. 5 and 6 the waist band 200 is folded double such that edges 202 and 204 are adjacent to each other. The shirt body 300 at this stage of the production has a uniform length and, as best seen in FIG. 7, has a raw bottom edge 302. The shirt body 300 can be made of a fleece material such as used in sweat shirts or can be made from other fabrics. The waist band 200 is connected along its edges 202 and 204 by a seam to the bottom edge 302 of shirt body 300. Although in this application the shirt body 300 is disclosed with the sleeves and neck band attached it should be understood that the waist band 200 can be, in accordance with this invention, attached to a shirt body before the sleeves and neck band are attached.

Figure 8:
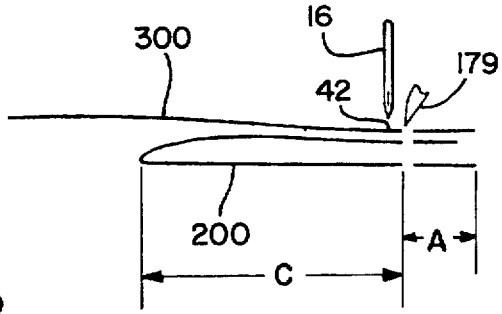
FIG. 8 is an end view depicting the amount, A. of the waist band that was trimmed off and wasted in the prior art method.
Figure 26:
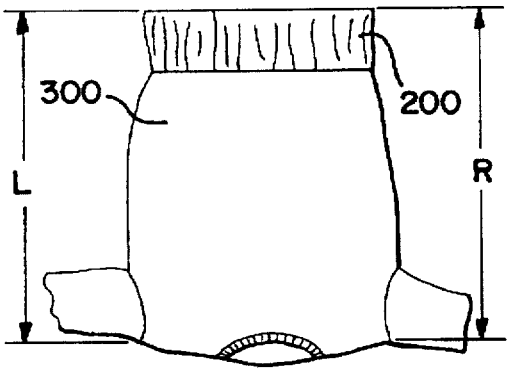
FIG. 26 is a top view of the finished garment.

In FIG. 5 the edges 202 and 204 are shown to be mismatch, which is intended to illustrate that, when manually folding the band in preparation for loading, it is difficult to maintain alignment of these edges. When the operation of attaching the folded waist band 200 to the shirt body 300 is performed manually the operator must attempt to maintain the edges 202, 204 and 302 aligned to insure that all three edges are stitched and the seam is closed. If any one of the edges drifts it will result in the waist band and or the finished garment having nonuniform dimensions and when the drift is excessive an edge will not be closed by the stitch. A garment such as that, with an open seam is an unacceptable commercial product. To accomplish a closed seam when manually performing this operation it is necessary to locate the stitch line 42 a relatively large distance from the untrimmed edges and trim off a non-uniform relatively wide ribbons from the two plies of the waist band 200 and the single ply of the shirt body 300. In FIG. 8 the fabric trim knife 179 and the needle 16 are illustrated and the width of the relatively wide ribbon of material that must be trimmed off is identified by the letter A. It should be noted that the ribbon of material that is trimmed off will have a non-uniform width. This non-uniform ribbon results in the finished band width, C in FIG. 8, and the finished garment length, L or R in FIG. 26, being non-uniform which diminishes the overall quality of the finished garment. A precision high quality finished band, identified in FIG. 9 by D is produced as a result of this invention. Furthermore, the precision uniform edge control of all three edges produces a balanced and accurate finished shirt length, which is illustrated in FIG. 26 where the length R of the right side of the finished garment is equal to the length L of the left side of the finished garment.

Figure 9:
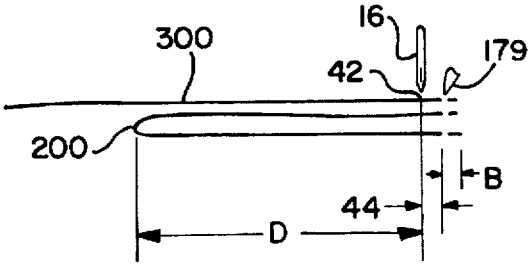
FIG. 9 is an end view depicting the amount, B, of the waist band that is trimmed off in the method of this invention.

In accordance with this invention the edges 202 and 204 of the waist band 200 and the edge 302 of the shirt body 300 are continuously subjected to precision dynamic active edge guiding such that alignment of all three edges is maintained. As a result, and as illustrated in FIG. 9, the ribbon B of material that must be trimmed off when using this invention is relatively narrow. Because the waist bands 200 is often made of very expensive material a substantial cost saving in material waste can be realized Thus this invention not only produces a precision finished band width, it also reduces excessive material waste cost.

Figure 2:
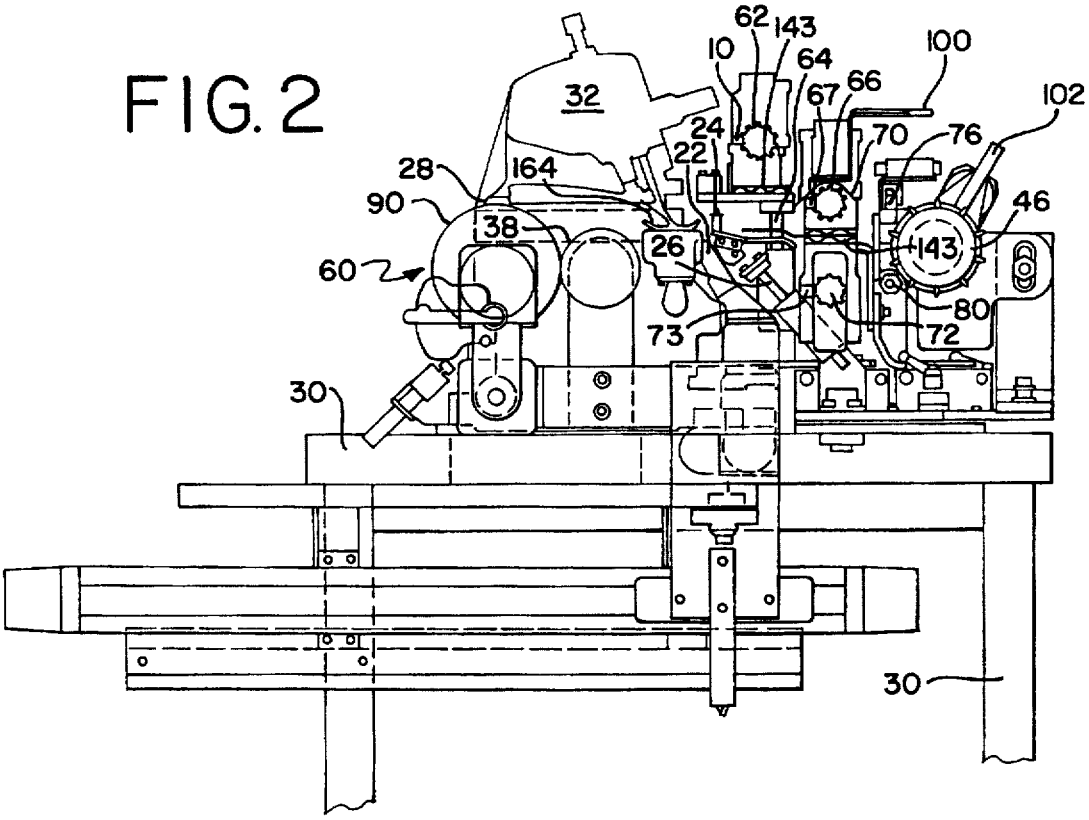
FIG. 2 is a front view of the machine of this invention.
Figure 27:
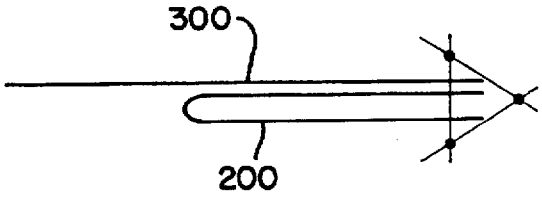
FIG. 27 is a symbolic representation of the preferred stitch used in this operation.

The sewing machine 32 and the workpiece control and advancing mechanism 60 will now be described in general terms with reference to FIGS. 1 and 2. In FIG. 1 the body edge sensor 10, upper 67 and lower 73 band edge sensors, coarse guider sensor 102 and the upper band edge guider cover 70 have not been shown to better illustrate other components of the machine. The components not seen in FIG. 1 are shown in FIG. 2 and other figures. The sewing machine 32, which is mounted on a frame 30, includes stitch forming instruments for forming a 504 SSa-1 seam including conventional components such as a needle 16, presser foot 164 and feed dog 162. A symbolic representation of a 504 SSa-1 overedge stitch is shown in FIG. 27.

The sewing machine 32 is equipped with a standard fabric trim knife 179 which is illustrated in FIGS. 8 and 9. A trimmed material venturi or chute 22 for receiving the waste material is provided and includes a vacuum device that can be activated by the microprocessor controller 50 at the appropriate time in the cycle for pulling the waste through the chute.

There are four edge guiders on the machine, a coarse guider 46, an upper edge guider 66, a lower edge guider 68 and a body edge guide 62. The upper edge guider 66, lower edge guider slide 68 and body edge guide 62 are all "fine" edge guiders as compared to coarse guider 46 which is a "coarse" guider. Although the "fine" and "coarse" guiders are structurally similar, the coarse guider is larger and performs somewhat different functions.

Figure 25:
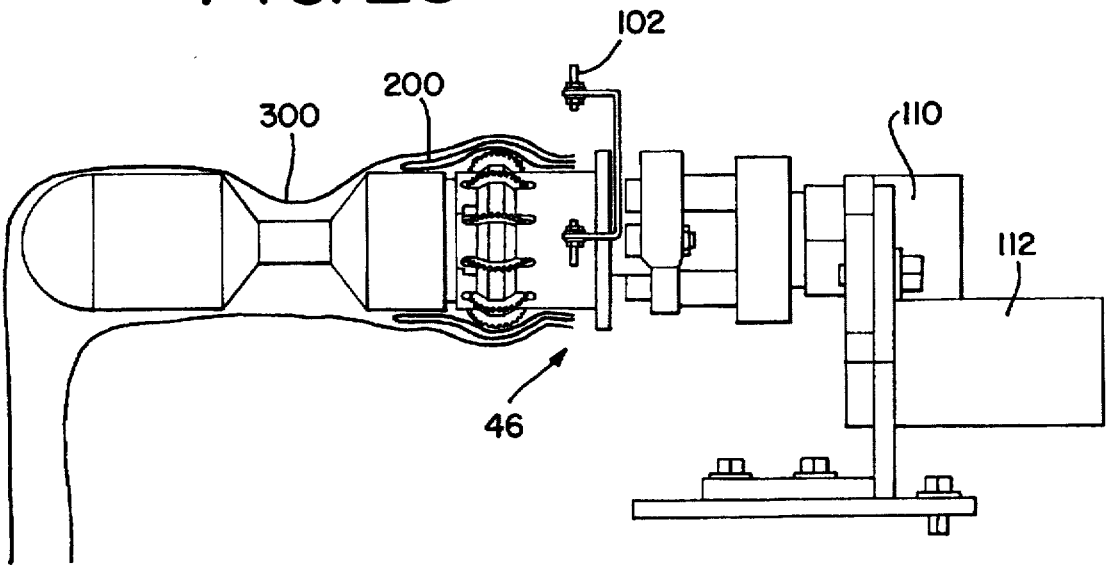
FIG. 25 is a side view of the coarse edge guider with the shirt body and waist band mounted thereon.

Coarse guider 46 having a band 200 and a shirt body 300 loaded is shown in FIG. 25. The main function of coarse guider 46 is to keep both the band 200 and the shirt body 300 on the general line of feed so that the "fine" guiders 66, 68 and 62 do not have to make large alignment corrections. This is an important function since it eliminates the potential of open seams. The coarse guider 46 also keeps the shirt body 300 and the sleeve 200 from falling off the machine in the event that an operator severely underloads the garment. The coarse guider 46 allows overloading because overloading will be instantly corrected during the pre-sew pull alignment cycle. In addition the coarse guider 46 helps the sewing machine 32 feed and thereby minimizes garment stretch and puckering. This combination of "coarse" and "fine" guiders provide this machine with an infinite alignment range which is not available with available guiders.

When the sewing machine 32 is running the shaft encoder 106 (see FIG. 1) sends pulses or signals to the microprocessor controller 50. Shaft encoder 106 sends one pulse for every rotation of the sewing machine motor, which is equal to one pulse for each stitch being produced by the sewing machine. The microprocessor controller 50 then feeds the proper pulses to the edge guiders to keep them in feed or speed synchronization with the sewing speed or feed rate. Thus, regardless of changes in sewing speed, which can occur at acceleration or deceleration of the sewing motor, the feeding guiders properly track the workpieces. This important feature of applicants invention eliminates over or under tensioning which could cause improper guiding and open seams, puckering or distortion in the seam or improper finished garment size.

The folded over waist band 200 is loaded in the form of a belt over coarse guider 46 and a tension roller 38 such that the edges 202 and 204 are adjacent to the presser foot 164. The tension roller 38 is journaled for rotation and mounted on the frame 30 so as to be shifted horizontally toward and away from the presser foot 164 and the coarse guider 46. The tension roller 38 is positioned by an air cylinder equipped with a brake. An encoder mounted to the cylinder informs the microprocessor 50 of the air cylinder's, and therefore the tension roller's, position. The microprocessor is programmed to actuate the air cylinder brake at the proper times based on this positional information. When the sewing machine 32 is in the "stand by" mode and ready for the loading of the waist band 200, the tension roller 38 is located close to coarse guider 46 which permits the waist band 200 to be loaded in a relaxed or un-stretched state. This greatly facilitates the loading of the waist band 200 since the operator is not required to physically stretch each waist band. The location of the tension roller 38 relative to the coarse guider 46 in the "stand by" mode can be adjusted to accommodate various styles and sizes of shirts. The location is controlled by the microprocessor controller 50 and the location can be programmed through the microprocessor control panel 52.

The waist band 200 is loaded first and is arranged such that its upper ply overlies the ply separator plate 143 and extends below the wheel of the upper band edge guider 66 and the upper band edge guider sensor 67. The lower ply of the waist band 200 underlies the ply separator plate 143 and extends above the wheel of the lower band edge guider 72 and lower band edge guider sensor 73. It should be noted that the upper band edge guider 66 and lower band edge guider 72 are mounted on the frame 30 such that they are movable vertically toward and away from the ply separator plate 143, and as shall be further discussed can be retracted horizontally, along with separator plate 143, from the line of stitch formation. While loading the waist band 200 the upper band edge guider 66 and lower band edge guider 72 are spaced away from the ply separator plate 143 to facilitate easy and fast loading. Also, the body edge guider 62 has been raised out of the way by the body edge guider lift cylinder 64 so as not to interfere with loading of the waist band 200. The tension roller 38 is positioned as close as possible to the presser foot 164 and coarse guider 46 and the shirt ejector 24 is retracted down and back to an inoperative position so as not to interfere with loading of the waist band 200. The rear puller 90 is pivoted to the left of its position as seen in FIG. 2, such that it is away from the tension roller 38 to provide loading clearance.

The microprocessor controller 50 is programmed to cause the lower band edge guider 72 and upper band edge guider 66 to move toward the ply separator plate 143 with the plies of the waist band 200 therebetween. At this point in the cycle the microprocessor controller 50 also causes the body edge guider 62 and shirt ejector 24 to move from their inoperative locations to their shirt body loading positions.

Simultaneously, the microprocessor controller 50 activates the cylinder that shifts tension roller 38 in the direction away from coarse guider 46. This places the waist band 200 in a semi-stretched state and at this time the rear puller 90 is activated which causes it to pivot against the tension roller 38 and pull the waist band 200 through the sewing machine 32. At the same time, upper band edge guider 66, lower band edge guider 72 and coarse guider 46 are activated so as to assist in pre-aligning the plies of the waist band 200 and forcing them under the pressor foot prior to loading the shirt body 300. In addition to guiding the workpiece edges the microprocessor controller 50 monitors the edge guider sensors 10, 67 and 73 to determine if any of the three fabric edges are being controlled. If there are no transitions in signal levels within a certain time period during any of the pre-sew pull alignment functions or in stitch counts during the sewing cycle, the microprocessor controller 50 will stop the operation and send a signal to the operator to resolve the problem. These band pre-align, body pre-align and sew cycle sensor checks serve to eliminate finished garment that have open seams. All of these functions are performed during the time period required for the operator to prepare to load the shirt body 300.

At the conclusion of the waist band pre-alignment cycle the rear puller 90 is caused to pivot back out of the way and the feeding action of the upper band edge guider 66 and lower band edge guider 72 is stopped; their edge guiding function however is continued. The edge guiding function of the edge guiders will be more fully discussed later with reference to FIGS. 10 through 14. At this time the feeding and guiding functions actions of the coarse guider 46 are also turned off.

The shirt body 300 is now loaded over the tension roller 38 then over the coarse guider 46. This action brings the shirt body edge into the open body edge guider 62 and over the band edge guider cover 70 while at the same time covering the material presence sensor 100. Material presence sensor 100 causes tension roller 38 to move left to a predetermined final stretch position. Simultaneously edge guider 62 closes and begins its edge guiding function while its feeding function is disabled during the stretch phase. When tension roller 38 reaches its final stretch position rear puller 90 rotates counterclockwise and comes into contact with the shirt body 300 pinching it to tension roller 38. Now coarse edge guider 46, rear puller 90, body edge guider 62, upper band edge guider 66 and lower band edge guider 72 simultaneously and at the same rate advance the shirt body 300 and the waist band 200 for a predetermined amount of time for the purpose of aligning the edges of the shirt body 300 and waist band 200 as well as bringing the edge of shirt body 300 under the raised presser foot 164. After this alignment advance "time out" presser foot 164 is lowered and the sew cycle is ready to begin.

The coarse guider 46, body edge guider 62, upper band edge guider 66 and lower band edge guider 72 are all functionally identical and thus only the body edge guider 62 will be discussed in detail. It should be noted that the edge guiding devices used in this application are substantially the same as those disclosed in the above identified U.S. Pat. Nos. 5,251,557 and 4,467,734 and U.S. application Ser. No. 08/123,000 and reference may be had to those patents for a more complete disclosure of the structural components of these devices. The edge guider 62 has a first stepper motor 110 for driving the feeding wheel 13 that functions to advance the ply of material in the material feed direction and a second stepper motor 112 for driving the gripper wheels 4 that function to move the ply of material normal to the material feed direction. The stepper motors 110 and 112, can be controlled to rotate a specific number of rotations or fraction of a rotation. Thus, depending upon the diameter of the drive element and the drive ratios, a ply of material can be advanced a specific distance upon receipt of an actuation instruction to the stepper motor to run a specific number of steps in synchronization with sewing speed or feed.

The entire guider 62 can be supported at one end on a horizontal pivot shaft 114. The other end, which is the material engaging head of the device, rest on the ply separator plate 143. The material engaging head can be lifted off the ply separator plate 143 by pivoting the entire device about horizontal pivot shaft 114. The body edge guider 62 can rely upon gravity or can include a mechanical device, such as a spring or an air cylinder, to assist in forcing the material engaging head toward the ply separator plate 143. The lower band edge guider 72 must include a mechanical device, such as a spring or air cylinder, to bias its material engaging head into contact with its ply separator plate 143. The body edge guider 62, upper band edge guider 66 and lower band edge guider 72 are each mounted on the frame 30 such that they can be automatically moved vertically, upon the actuation of a air valve, from an inoperative to an operative position or slid in the horizontal direction from their operative location to a position at which their material engaging heads are no longer on the stitch line 42.

Figure 10:
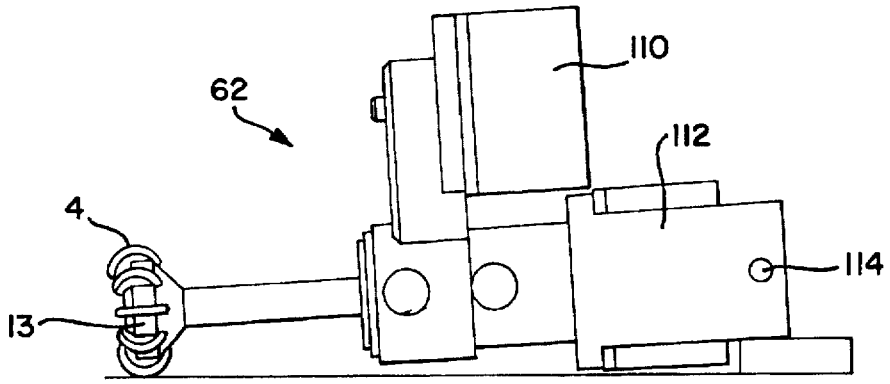
FIG. 10 is a side view of an edge guiding device of the type used in the automatic ply aligning and positioning mechanism of this invention.
Figure 11:
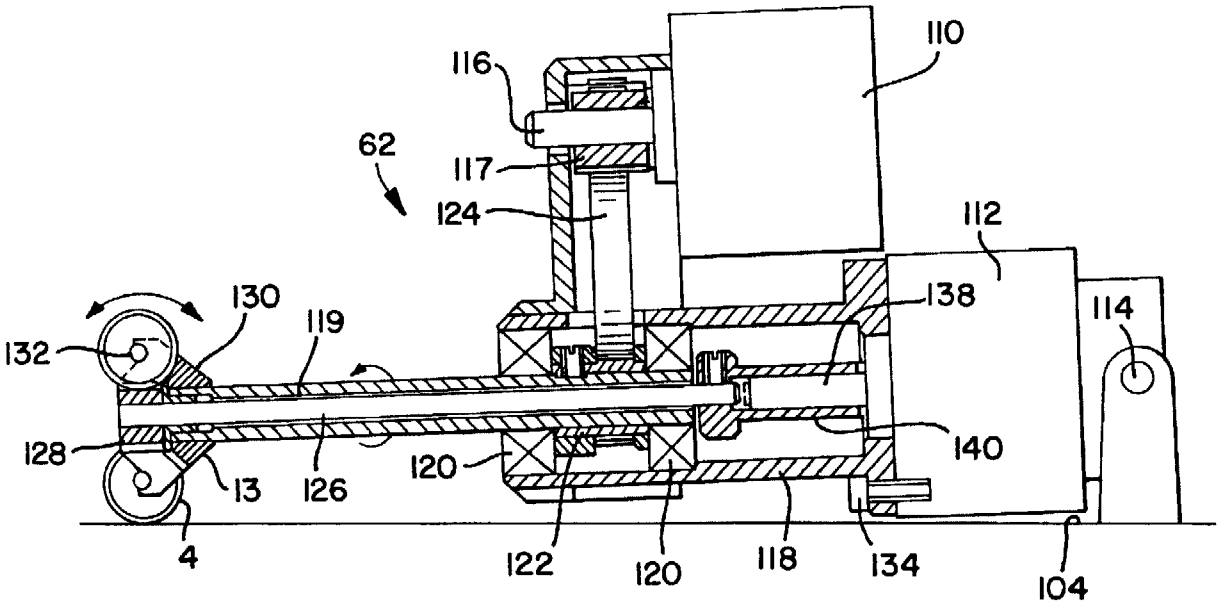
FIG. 11 is a cross section view of the edge guiding device seen in FIG. 10.

FIG. 11 is a cross section view of the body edge guider 62 seen in FIG. 10. A housing 118 has the first stepper motor 110 mounted to its outer surface. First stepper motor 110 has an output shaft 116 with a pinion 117 secured thereto. A hollow shaft 119 is mounted for rotation by bearings 120 in the housing 118 and has a pinion 122 secured thereto. Pinion 122 is mechanically connected by way of a toothed belt 124 to pinion 117. Rotary drive is transmitted from stepper motor 110 through toothed belt 124 to the hollow shaft 119. A feeding wheel 13 is fixed to the free end of hollow shaft 119 and thus rotates therewith. The feeding wheel 13 has a plurality of openings 130 formed therein in which gripper wheels 4 are mounted for rotation on shafts 132. The peripheral edges of gripper wheels 4 are in driving engagement with worm gear 128 and are caused to rotate thereby. Worm gear 128 is secured to the free end of shaft 126 that is mounted for rotation within the hollow shaft 119.

The housing 118 is secured to one end of second stepper motor 112 by bolts 134. The other end of second stepper motor 112 is pivotally mounted to the base 104 of the sewing machine 32 about a pivot shaft 114. The output shaft 138 of second stepper motor 112 is secured to shaft 126 by a coupler 140. The feeding wheel 13 of body edge guider 62 can be lifted off ply separator plate 143 by pivoting the edge guider 62 upwardly about shaft 114.

Figure 12:
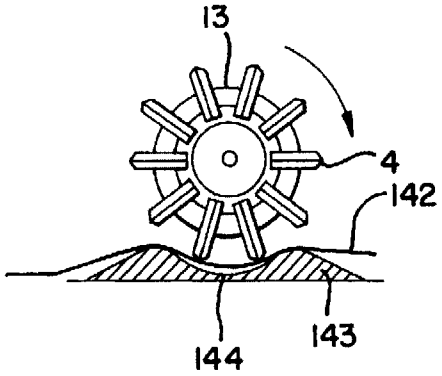
FIG. 12 is an end view of the feeding and guiding wheel head of the edge guiding device seen in FIG. 10.

FIG. 12 is an end view of the feeding wheel 13 and includes a ply of material designated 142 which is the shirt body 300. Material 142 is located between the peripheral edge of feeding wheel 13 and the ply separator plate 143. Ply separator plate 143 has a cylindrical shaped concave surface 144 that cooperates with the peripheral edges of gripper wheels 4 to grip the material 142 so as to feed it in the precise amount intended. As a result of the concave shape of surface 144 a plurality of gripper wheels 4 can be in engagement with the material 142 at the same time which enhance the control and precision of this feed.

The sensors used with the edge guiders of this invention are of the retro-reflective type which emit rays that are reflected back to the sensor. The emitted rays are directed at a highly reflective surface, or a surface to which reflective tape has been applied. When the ply of material moves into the area where the rays are directed there is a blockage of rays that would be reflected back to the sensor. This blockage is detected by the sensor and thus its state is changed.

Diffuse type sensors could also be used. Diffuse type sensors recognize characteristics of a particular type of surface that they are intended to sense and do not require the presence of a highly reflective surface.

It is important to the operation of this invention that the sensors for all edge guiders be directionally coordinated such that they all attempt to guide the material edge that they are monitoring the same distance from the line of stitching. If the aim of one sensor is off, in the direction that will cause the marginal edge of the material to be spaced from the stitch line a greater distance than for the other layers of fabric, then a wide ribbon of excess waste material will be trimmed from the one layer. This is unacceptable because of the material that is wasted. However, if the aim of one sensor is off in the other direction, such that the material edge being monitored by this sensor is missed by the line of stitches then the seam is defective and the completed piece will be unacceptable.

Figure 13:
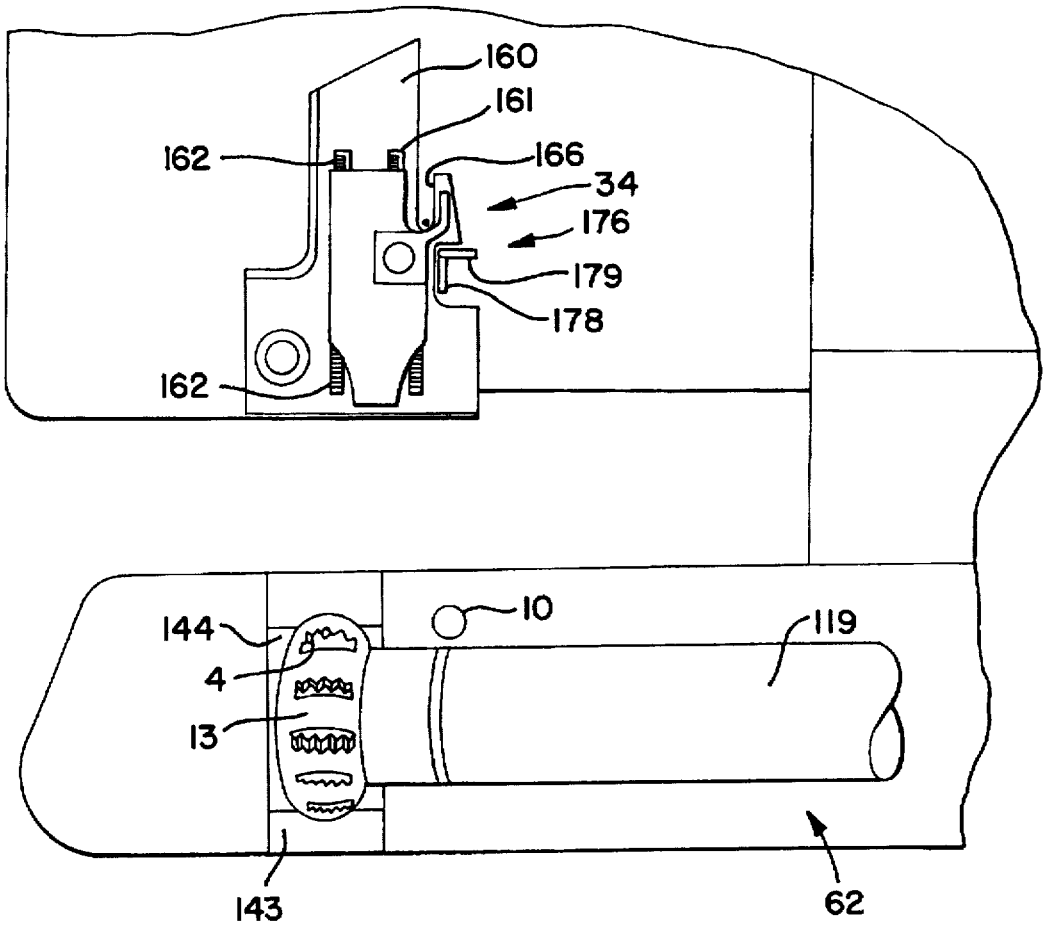
FIG. 13 is a top view of a portion of the sewing machine 32 taken along a plane above the pressor foot 164.
Figure 14:
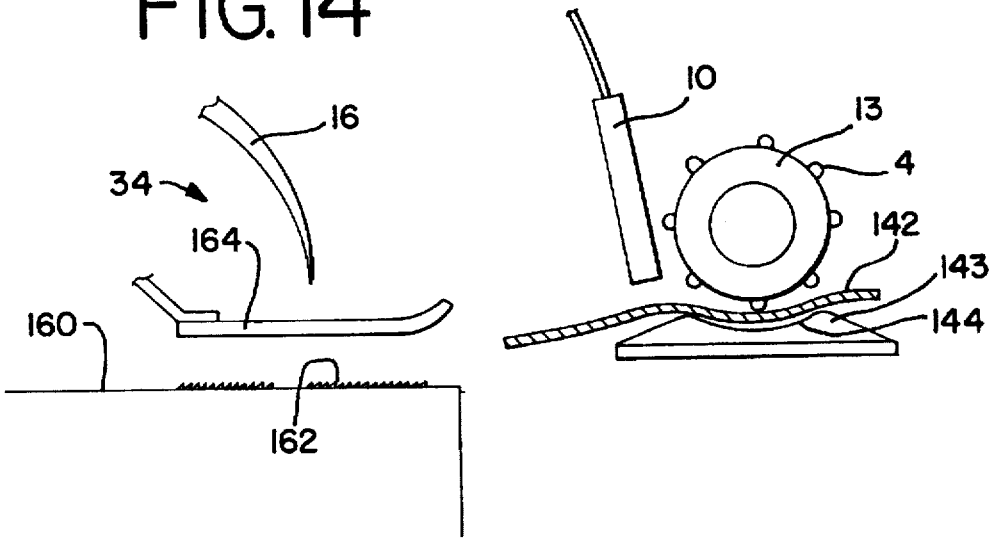
FIG. 14 is a diagrammatic end view illustration of a portion of the material loading and stitch forming mechanisms of the sewing machine seen in FIGS. 1 and 2.

An example of the invention, in which the shirt body 300 is being controlled by the body edge guider 62 and fed to the stitch forming instruments 34, will be discussed referring to FIGS. 13 and 14. In these views only the body edge guider 62 is illustrated. The feeding wheel 13 with several gripper wheels 4 are seen, at the free end of hollow shaft 119. The body edge guider 62 overlies the ply separator plate 143. The feeding wheel 13 is resting on surface 144 of the ply separator plate 143. The shirt body 300 is loaded by moving its edge 302 to the right, as seen in FIG. 13, until it is under the feeding wheel 13. Depending upon the thickness of the ply of material, it may be necessary to raise the feeding wheel 13 by pivoting the body edge guider 62 about its pivot 114. The gripper wheels 4 are actuated at this time, and since the sensor is not covered the gripper wheels 4 are rotating in the direction to move the material to the right, as seen in FIG. 13.

The term "margin edge" when used in this patent means the edge of the material that extends along the direction of material feed.

As the gripper wheels 4 move the material to the right the margin edge 302 of the material approaches the point at which the body edge guider sensor 10 is directed. A reflective surface is provided at this point and when the reflective surface is not covered by the material the ray from the sensor is reflected back to the sensor. The edge guiders of this invention have been programmed such that when the sensor ray is reflected back the gripper wheels rotate in one direction and when the reflective surface is covered by the material, preventing the sensor ray from reflecting back, the gripper wheels rotate in the opposite direction. Thus, when the body edge guider sensor 10 recognizes the margin edge of the material it causes the drive to the top gripper wheels 4 to reverse which moves the material to the left in FIG. 13. This movement of the material uncovers the reflective surface and allows the sensor ray to again reflect back and reverses the direction of rotation of the gripper wheels 4. Thus, the direction of rotation of gripper wheels 4 is being continuously alternated. This causes the edge of the material to be maintained at the desired position. In the example being discussed the drive to feeding wheel 13 is controlled independently through stepper motor 110 and functions to move the materials toward the stitch forming area. As the material is being advanced toward the stitch forming area it is also under the constant control of the gripper wheels 4 which functions to maintain the marginal edge at the desired position until they are retracted.

As best seen in FIG. 13 the top surface of the sewing machine includes a throat plate 160 including slots 161 through which feed dog elements 162 project. Throat plate 160 also includes a slot 166 through which the needle 16 moves. The needle 16 is illustrated as having an arcuate shaped however this invention can also be used with sewing machines using straight needles. On the right hand side of the throat plate 160 (FIG. 13) an edge trimmer 176 is shown. The edge trimmer 176 includes a lower fixed knife 178 and an upper moveable trim knife 179.

The process of loading the waist band 200 and shirt body 300 on the machine and completing the sewing cycle will now be discussed in more detail with reference to FIGS. 15 through 18.

Figure 15:
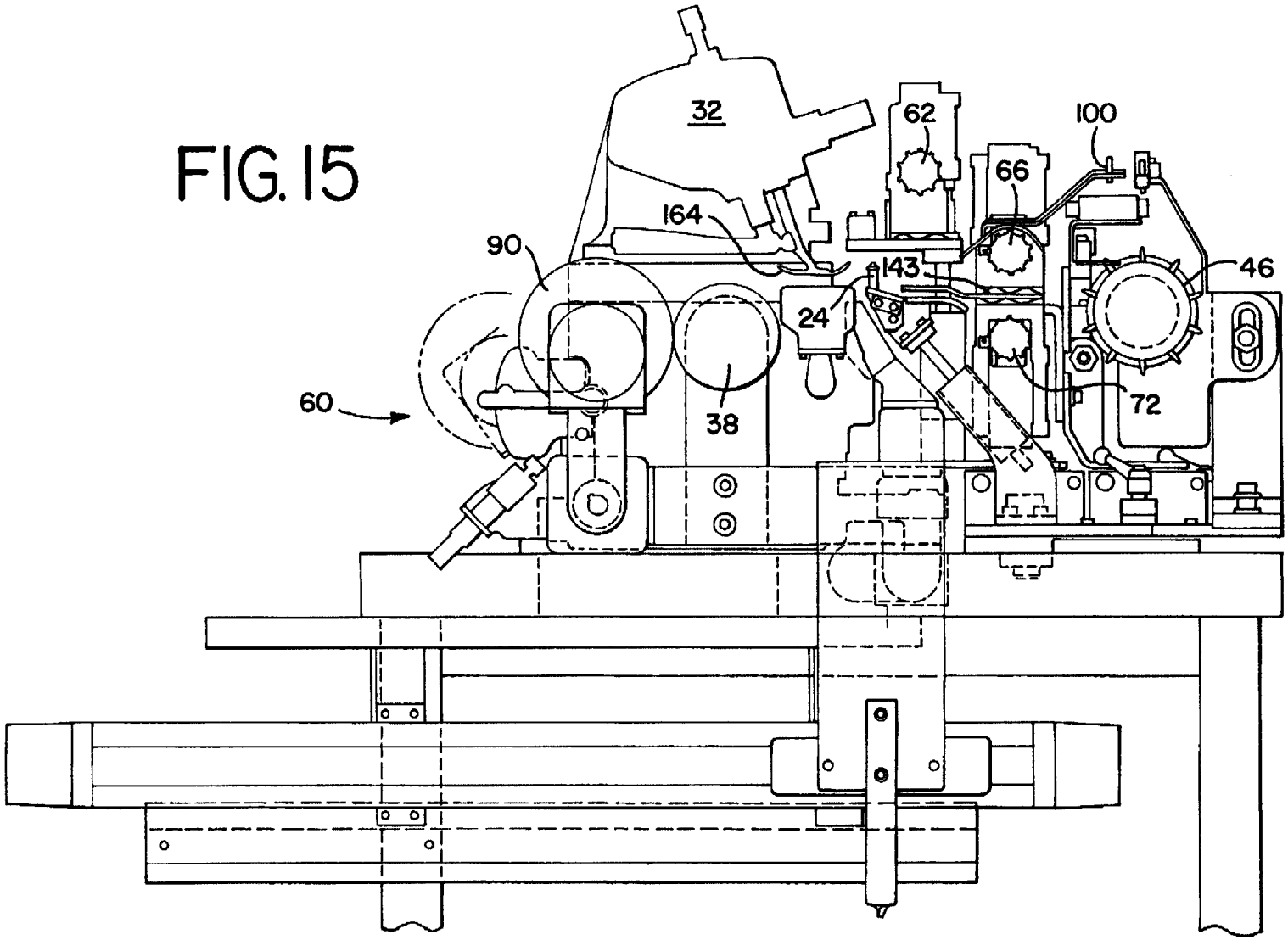
FIG. 15 is a front elevation view of the machine.

In FIG. 15 the sewing machine 32 and the workpiece control and advancing mechanism 60 are shown in "stand by" mode ready for the waist band 200 to be loaded. The upper band edge guider 66 and lower band edge guider 72 are shown in the open positions. The body edge guider 62 is open and lifted out of the way so as not to interfere with loading of the waist band 200. The tension roller 38 is positioned as close as possible to the sewing machine presser foot 164 and the shirt ejector 24 is retracted to its inoperative location so as not to interfere with loading of the waist band 200. The rear puller 90 is shown in contact with tension roller 38 but will in the "stand by" mode be pivoted back to the left and away from the tension roller 38 to provide loading clearance for the waist band 200. The "stand by" mode of the rear puller is shown in broken lines.

Figure 16:
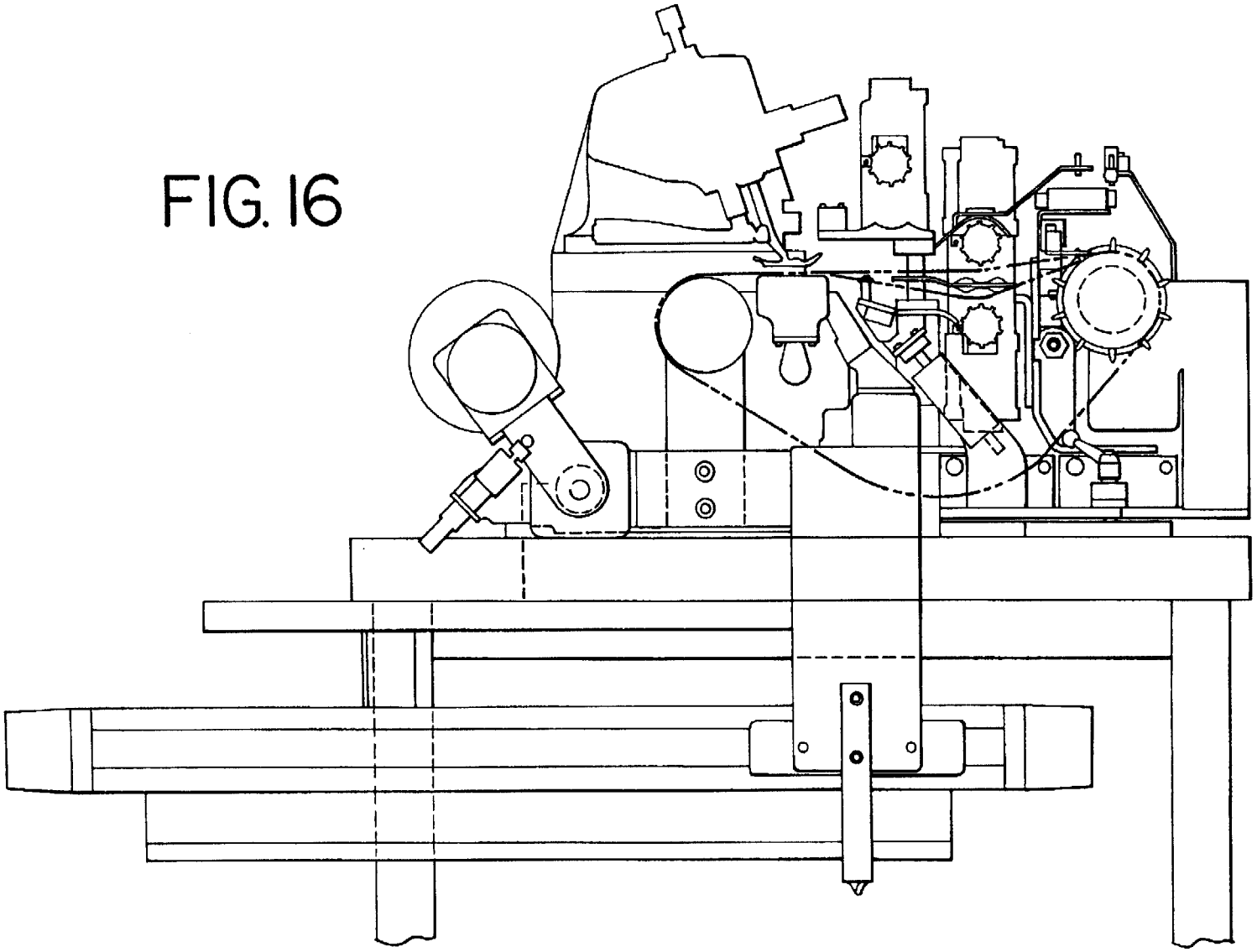
FIG. 16 is a front elevation view of the machine showing the relaxed folded band loaded on the machine.

According to one embodiment of loading procedure, the operator picks up a waist band 200 and folds it in half so that its edges 202 and 204 are adjacent as illustrated in FIG. 5. With the waist band 200 in a relaxed state and the machine in the "stand by" mode, the operator loads it over the coarse guider 46 and over the tension roller 38 with the top ply of the upper rung overlaying the top surface of ply separator plate 143 and the bottom ply of the upper rung underlaying the bottom surface of ply separator plate 143. As the waist band 200 is slipped over the coarse guider 46 a material presence sensor 100 is covered and causes a signal to be sent to the microprocessor controller 50. This signal causes the microprocessor controller 50 to activates a time delay. During this time delay the operator moves his or hers hands away from the loading area to pick up the shirt body 300. When the time delay expires the microprocessor controller 50 causes the upper band edge guider 66 and the lower band edge guider 72 to move to their loading positions and to close down on the plies of the waist band 200. At this time in the cycle the lift solenoids for the body edge guider 62 and shirt ejector 24 are actuated by the microprocessor controller 50 which causes them to move into their loading position. FIG. 16 illustrates the sewing machine 32, workpiece control and advancing mechanism 60 and the waist band 200 at this stage of the loading cycle.

At the same time that body edge guider 62 and shirt ejector 24 are moved into their loading positions the cylinder for shifting tension roller 38 is activated which places the waist band 200 in a semi-stretched state. Then, the rear puller 90 is activated by the microprocessor controller 50. Actuation of the rear puller 90 causes it to rotate and pivot to a position where it is against the tension roller 38 where it functions to feed or pull the waist band 200 through the sewing machine 32. The upper band edge guider 66 and lower band edge guider 72 are activated at this same time and they function to pre-align the plies of the waist band 200. During this pre-align function the microprocessor controller 50 monitors the edge guider sensors 67 and 73 to determine if the edges of the band 200 are being controlled. If there are no transitions in signal levels within a certain time period during the pre-align functions, the microprocessor controller 50 will stop the operation and send a signal to the operator to resolve the problem.

This pre-aligning of the waist band 200 is done prior to loading the shirt body 300. All of these functions occur in the short time period that it takes the operator to pick up and prepare to load the shirt body 300. At the end of the pre-alignment cycle for the waist band 200 the rear puller 90 is pivoted back out of the way and the feeding action of upper band edge guider 66 and lower band edge guider 72 are turned off. In other words the feeder wheel 13 is not rotating. Although the feeding action of the upper band edge guider 66 and lower band edge guider 72 has been turned off their edge guiding function continues to function. Thus, gripper wheels 4 continue to rotate and respond to the sensors 67 and 73. At this stage of the loading cycle the feeding and guiding action of the coarse guider 46 is turned off.

Figure 17:
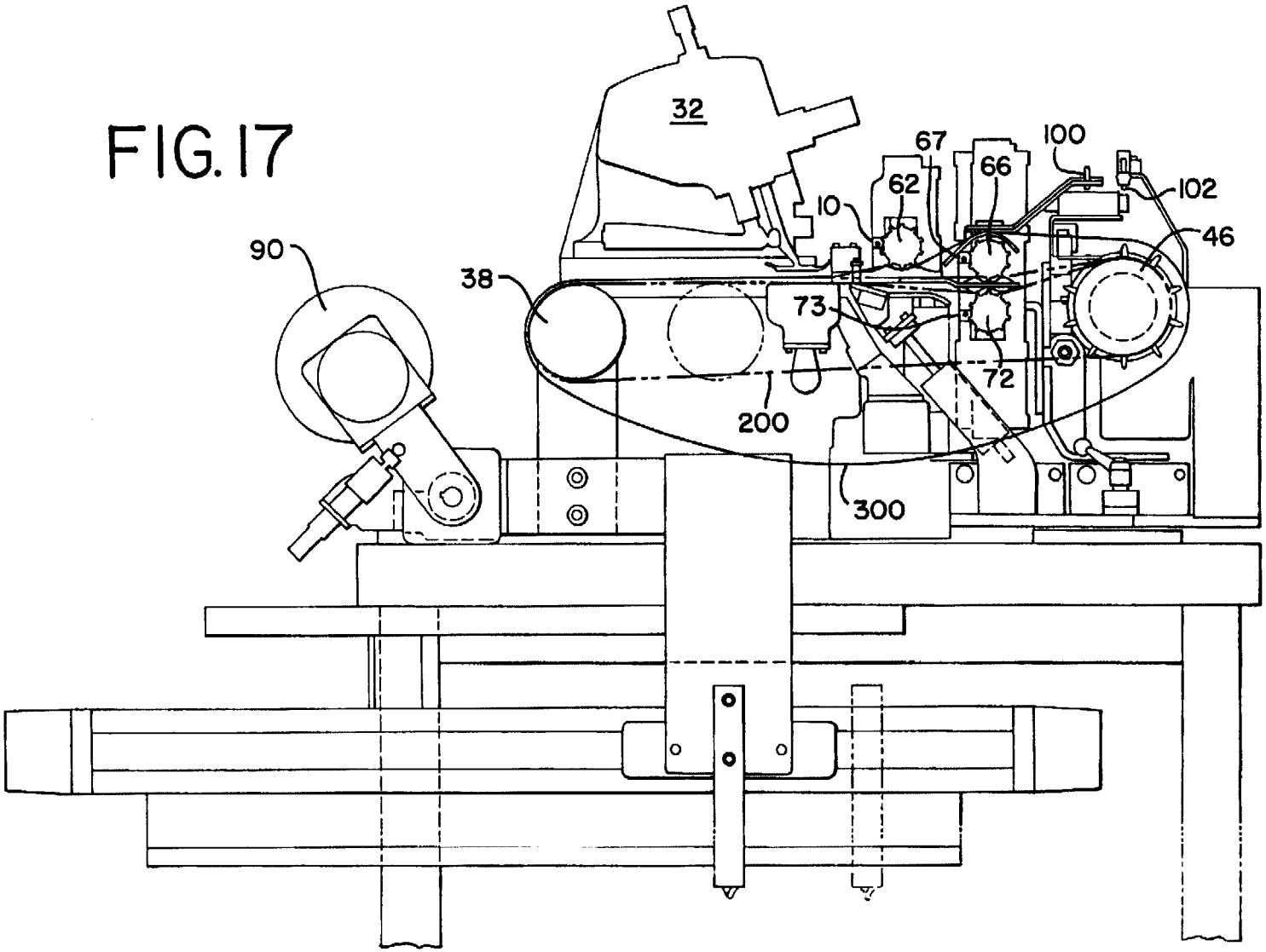
FIG. 17 is a front elevation view of the machine showing the semi-relaxed shirt body loaded onto the machine over the band.

FIG. 17 shows the waist band 200 in its semi-stretched state after its pre-alignment cycle has been completed.

Figure 18:
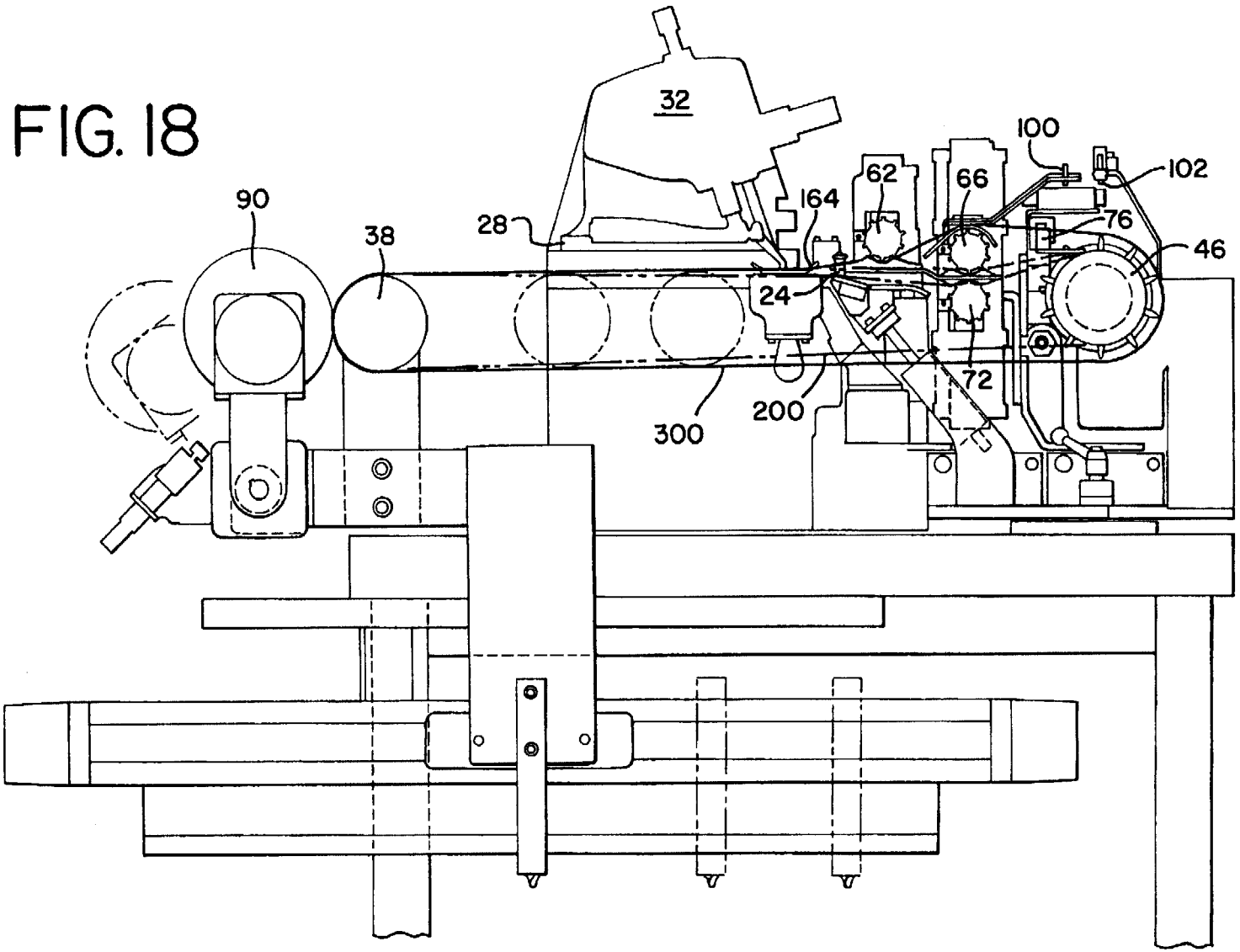
FIG. 18 is a front elevation view of the machine showing the band and body in the final tensioned position ready for starting the sewing operation.

The operator now stretches the bottom edge 302 of the shirt body 300 and slips it over the waist band 200. The body edge guider 62 has been actuated at this time such that it is in its edge guide mode. The gripper wheels 4 are rotating and function to pull in the edge 302 of the shirt body 300 as soon as the operator places the edge 302 under a gripper wheel 4. Thus the function of pre-aligning the shirt body 300 begins before the loading operation is completed. As the shirt body 300 is being loaded into the body edge guider 62 and over the coarse guider 46 the material present sensor 100 is covered which results in the microprocessor controller 50, starting a time delay period and sending a signal to the tension roller 38 causing it to expand the waist band 200 and the shirt body 300 out to the sew tension position as is shown in FIG. 18. When the time delay period, that was started when the material present sensor 100 was covered by the shirt body 300, expires a pre-sew alignment process is initiated. During this process the microprocessor controller 50 actuates the rear puller 90 that functions to pull the shirt body 300 under the presser foot 164 which aligns the edge 302 with the fabric trim knife 179. The upper band edge guider 66, lower band edge guider 72 and the body edge guider 62 are all actively assisting in this pre-sew alignment process. At the conclusion of the pre-sew alignment process the presser foot 164 is lowered into contact with the workpiece and the sewing begins.

The coarse guider 46 with the shirt body 300 and sleeve 200 loaded thereon is shown in FIG. 25. During the sewing cycle the coarse guider 46 maintains alignment of the waist band 200 and shirt body 300 for the band guiders 66 and 72 and the body edge guider 62. When the sewn seam trips the seam detector 76, the band guiders 66 and 72 are retracted after a pre-determined stitch count, and then the body edge guider 62 is retracted after a slightly longer predetermined stitch count.

When the band guiders 66 and 72 are retracted, excess body material exists because the path of the shirt body 300 from the needle 16 to the point of retraction is greater than the path of the waist band 200 from the needle 16 to the point of retraction. If this situation, is not corrected, it will result in an unacceptable pleat being formed at the end of the seam. However, such an unacceptable pleat has been avoided by causing the coarse guider 46 feed function speed to be retarded relative to the head sew speed thus holding the material plies in slight tension and thereby eliminating the excess material that would have caused the pleat.

When the seam has been completed, and a programmable stitch count has elapsed, the shirt ejector 24 is extended by its ejector solenoid which functions to push the seam out from under the needle 16 and presser foot. The sewing head continues to run after the shirt seam has been ejected and a chain is produced. While the chain is being produced the tension on the needle thread is released which contributes to the production of a more balanced chain. The chain is sucked into a vacuum chain cutter and is severed. The severed chain is disposed of through a chain venturi or chute 28 which includes a vacuum mechanism that can be activated by the microprocessor controller 50 at the appropriate time in the cycle for pulling the waste material through the chute. The coarse guider 46 continues its function of feeding and guiding the edge of the product having the sewn seam so that accurate alignment at the end of the sewing process is maintained. At this time the rear puller 90 continues to be active. This continued control over the workpiece prevents the seam from inadvertently drifting into the path of the trim knife 179.

Sewing is automatically stopped a predetermined number of stitches after the seam detector 76 detects the beginning of the seam. Since the distance between the point where the seam is detected and the needle 16 is relatively short and constitutes a small portion of the complete seam length overseaming is maintained to a minimum. When sewing is stopped the presser foot 164 is lifted, the rear puller 90 is retracted away from the workpiece and the tension roller 38 is shifted to it's stand-by position (FIG. 16).

Figure 19:
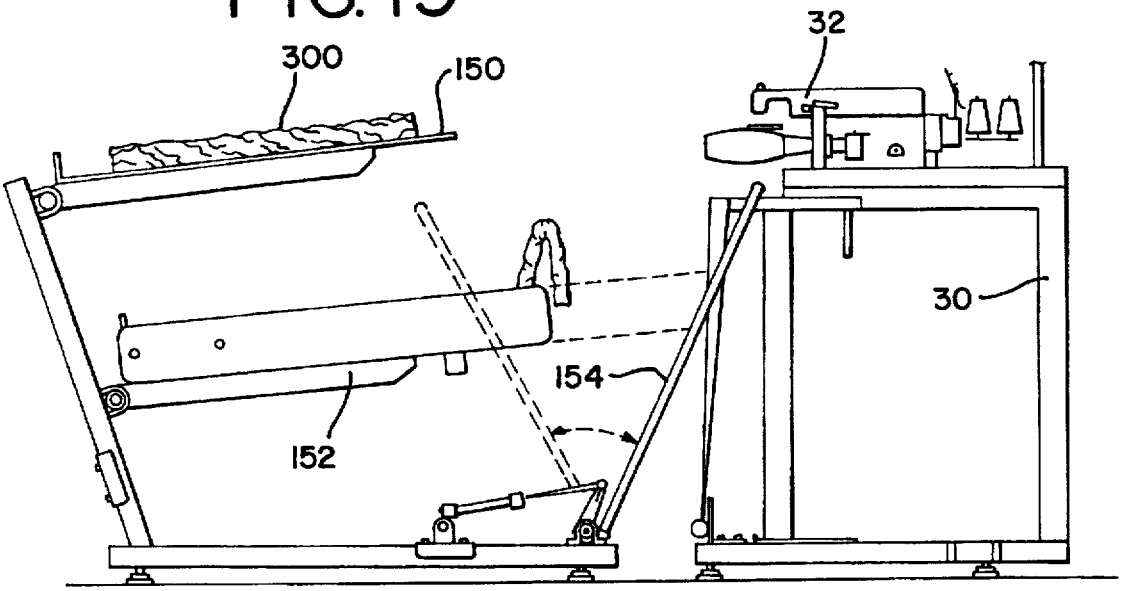
FIG. 19 is an end view of the sewing machine and the workpiece stacker.
Figure 20:
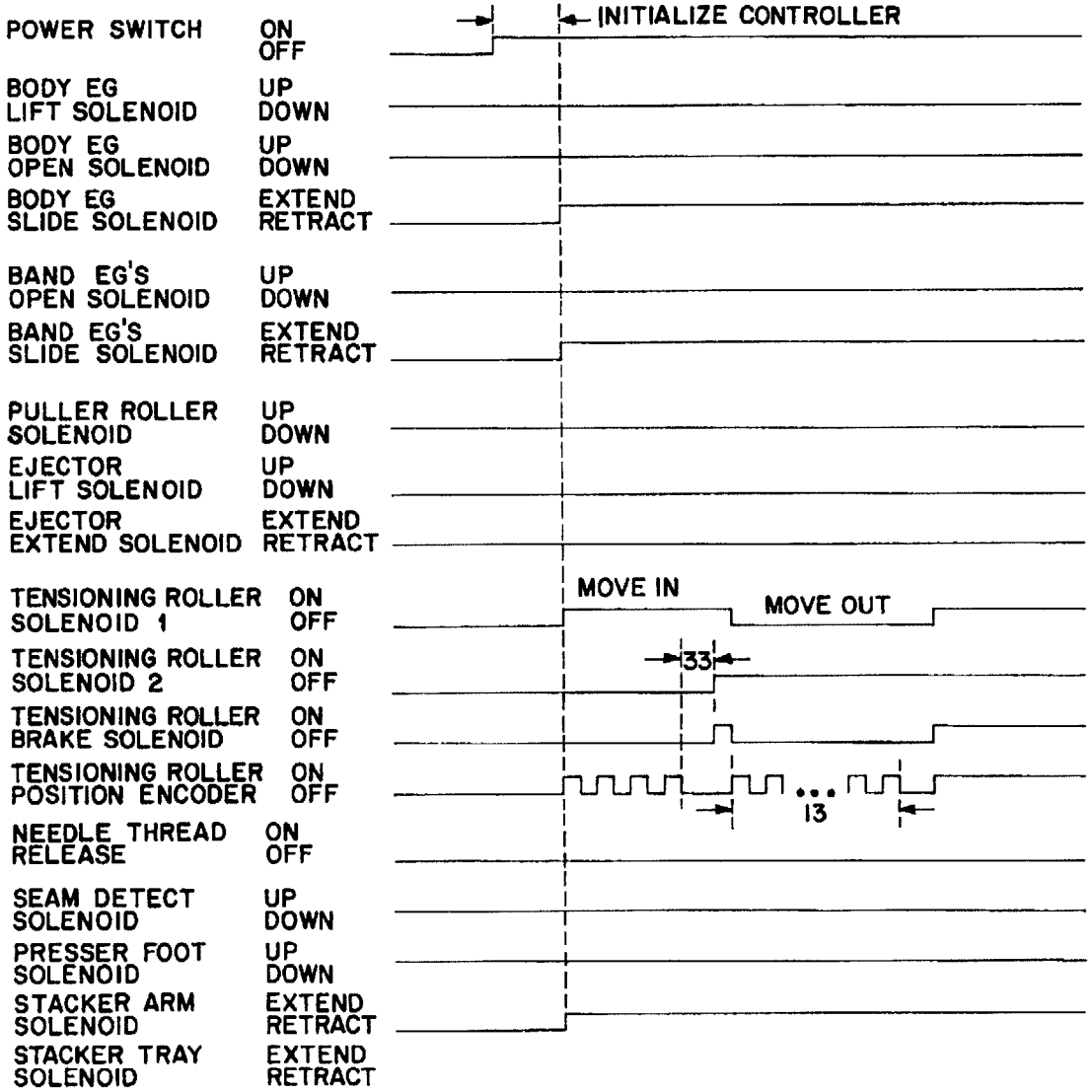
FIG. 20 is a timing diagram for the system's power up sequence.

FIG. 19 is an end view of the sewing machine 32 and frame 30 and the stacking mechanism. The stacking mechanism includes an upper stacker tray 150 upon which the unsewn shirt bodies 300 are stored and a lower stacker tray 152 upon which the sewn shirt are stacked. The stacking mechanism also includes a stacker pivot arm 154 that is pivotally mounted at its lower end and swings from its standby position, shown in full lines, through an arc of about 45 degrees. The lower stacker tray 152 is extended toward the sewn shirt body to a location shown in broken lines. When lower stacker tray 152 reaches this location the stacker pivot arm 154 rotates toward the lower stacker tray 152 and deposits the sewn shirt on tray 152. The stacker pivot arm 154 then returns to its standby position. FIG. 20 is a timing diagram for the system's power up sequence.

After the controller has been initialized the slide solenoids are extended for the body edge guider 62, upper band edge guider 66 and lower band edge guider 72 are extended. The tension roller 38 is moved in to its home position closest to the sew area and then back out to its waist band load position. The tension roller 38 has a settling time that is identified as 33 on FIG. 20. If encoder pulses are not received within this number of milliseconds, the idler roller is considered to be stopped. The position of the tension roller 38 for loading the waist band 200 can be adjusted for different sizes and styles. The square waves shown in the line entitled, TENSIONING ROLLER POSITION ENCODER, indicate encoder pulses and the number of encoder pulses in the distance 13 indicates the number of encoder pulses from the sewing head to the waist band load position. The number of encoder pulses in distance 13 can be controlled through the microprocessor control panel 52. The stacker arm solenoid is extended during this sequence.

Figure 21:
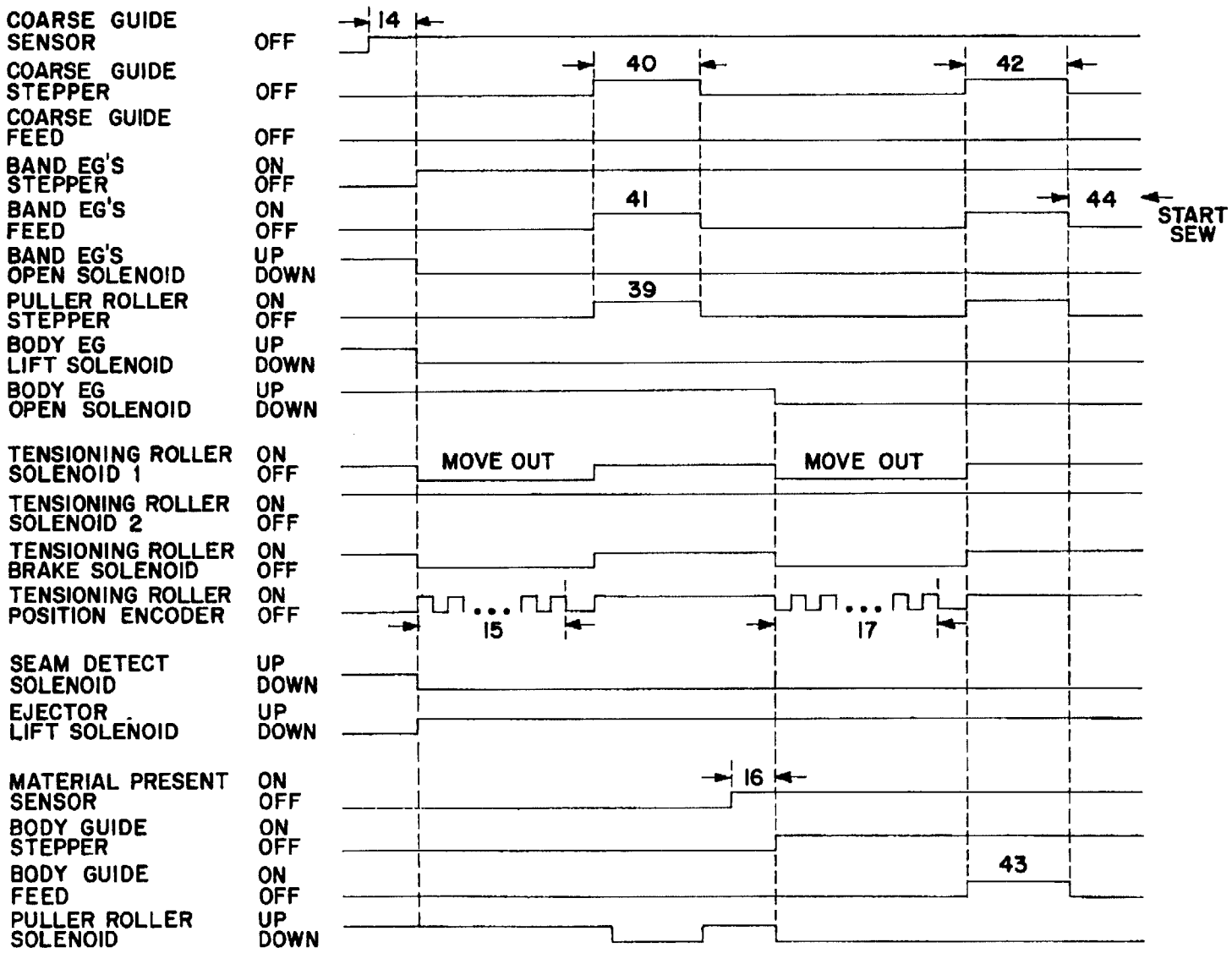
FIG. 21 is a timing diagram for the system's load sequence.

FIG. 21 is a timing diagram for the system's load sequence. The time, expressed in milliseconds, indicated by 14 is the time that is waited after the material presence sensor 100 is covered before enabling the upper band edge guider 66 and the lower band edge guider 72. The time span indicated by 40 is the duration of the waist band 200 align sequence and 242 indicates the duration of the shirt body 300 align sequence. Reference numbers 41 and 39 indicate respectfully, the speed of band edge guider's feed motors and the speed of the rear puller 90 during the band align or body align sequence. After the shirt body 300 align sequence the system will wait the number of milliseconds indicated by 244 before starting the sewing sequence. Reference number 15 indicates the number of encoder pulses that occur from the sewing head to the position at which the tension roller 38 is stopped when loading the shirt body 300. Reference number 17 indicates the number of encoder pulses that occur from the sewing head to the position at which the tension roller 38 is stopped for sewing. Reference numeral 216 indicates the number of milliseconds that is waited after the material present sensor 100 is covered before activating the body edge guider 62. Reference number 43 indicates the speed of the body edge guider's feed motor. The times 13, 40, 216 242 and 244, the speeds 39, 41 and 43 and the encoder pulses 15 and 17 can all be changed by the machine operator by entering new figures through the microprocessor control panel 52. This is a significant feature of this invention since it enables the machine to be adjusted for different size or style of workpieces by a simple and quick control panel 52 entry.

Figure 22:
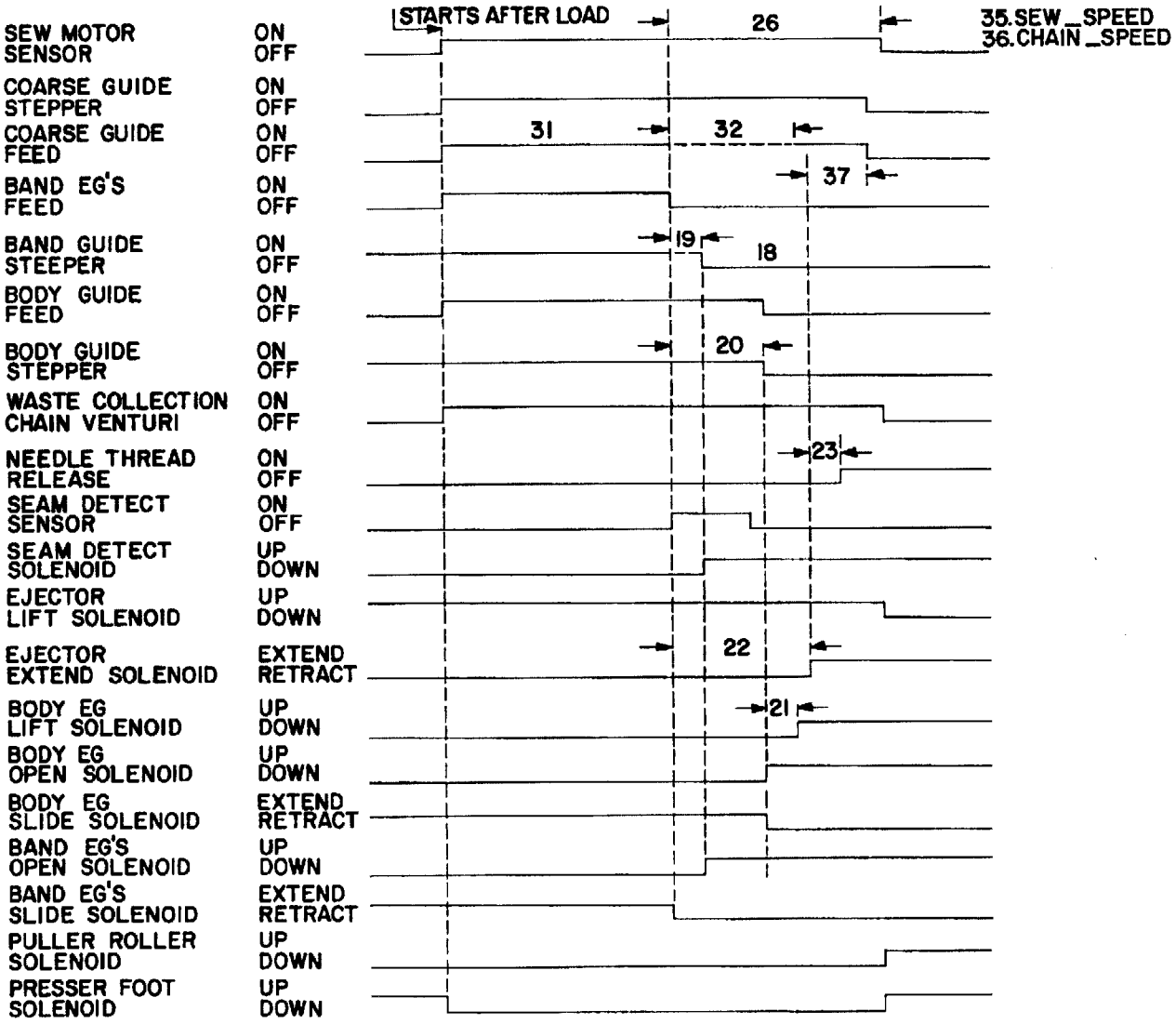
FIG. 22 is a timing diagram for the system's sew sequence.

FIG. 22 is a timing diagram of the system's sew sequence. Reference number 26 identifies the number of milliseconds that the sewing head will remain activated after the seam detector 76 has detected the seam. Reference number 35 indicates the sewing speed for the sewing cycle and reference number 36 indicates the sewing speed for the chaining cycle. After the shirt ejector extend cylinder 26 is extended the sewing speed will be automatically changed from 35 to 36. After the seam is detected, the tension in the coarse guider 46 will be changed to reduce the gap between the waist band 200 and the shirt body 300. This new tension is indicated by reference number 31. This end of stitch tension 31 will have a duration that is indicated by reference number 32. After the shirt ejector extend cylinder 26 has extended the coarse guider 46 will remain on for the number of stitches indicated by reference number 37. The speed of the band edge guider stepper motors in pulses per second during the time that the band edge guiders 66 and 72 are retracted is indicated by reference number 18 and the retract duration is indicated by reference number 19. After the seam detector 76 detects the seam the system will continue to sew for a number of stitches indicated by reference number 20 before retracting the body edge guider 62. After the shirt ejector extend cylinder 26 has been extended the system will continue to sew for the number of stitches indicated by reference number 23 before releasing the needle thread tension. After the seam detector 76 detects the seam the system will continue to sew for the number of stitches indicated by reference number 222 before extending the shirt ejector 24. When the body edge guider 62 is retracted, it will be retracted for a duration indicated by reference number 21.

Figure 23:
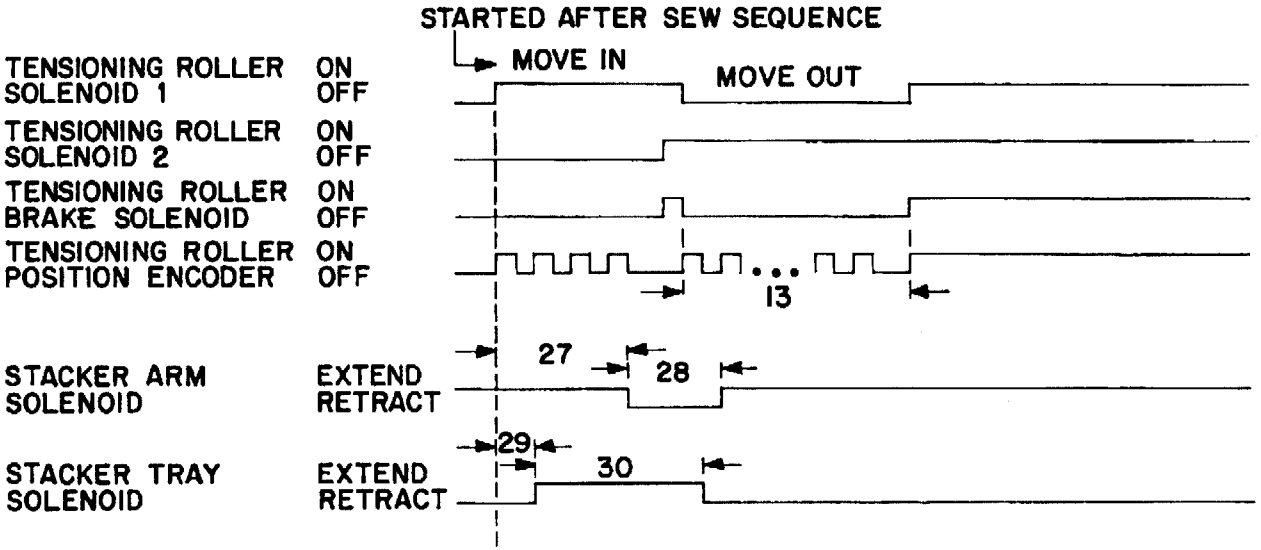
FIG. 23 is a timing diagram for the system's stack sequence.

FIG. 23 is a timing diagram of the system's stack sequence which starts after the sew sequence. At the end of the sewing sequence the presser foot 164 is lifted, the needle 16 is sent to its up position, the sewing motor is turned off and the rear puller 90 is retracted away from the shirt. The tension roller 38 is moved to a standby position a predetermined number of encoder pulses, indicated by reference number 213, from the sewing head. There is a programmed delay, measured in milliseconds and indicated in the diagram by reference number 27, from the competition of sewing until the stacker arm 154 is retracted. The stacker arm 154 will remain retracted for a time period, measured in milliseconds and indicated in the diagram by reference number 228. The stacker tray 152 will be extended after a programmed number of milliseconds, indicated by reference number 29 in the diagram.

Figure 24:
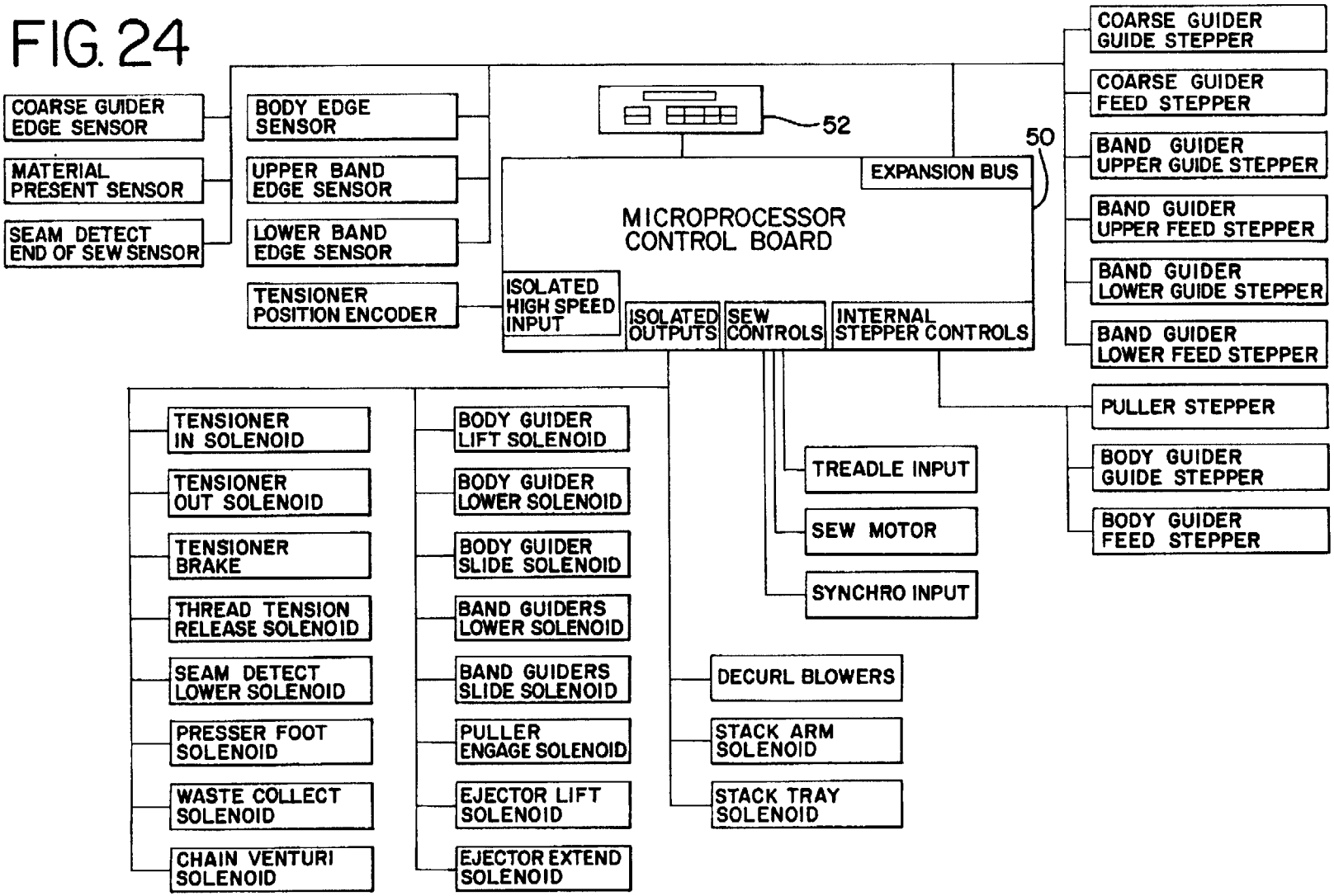
FIG. 24 is a block diagram of the systems microprocessor controller and electronic controls.

FIG. 24 is a block diagram that includes the systems microprocessor controller 50, as well as the components that it controls, the stepper motors it controls, the sensors, the solenoids it controls and the input devices.

Figure 28:
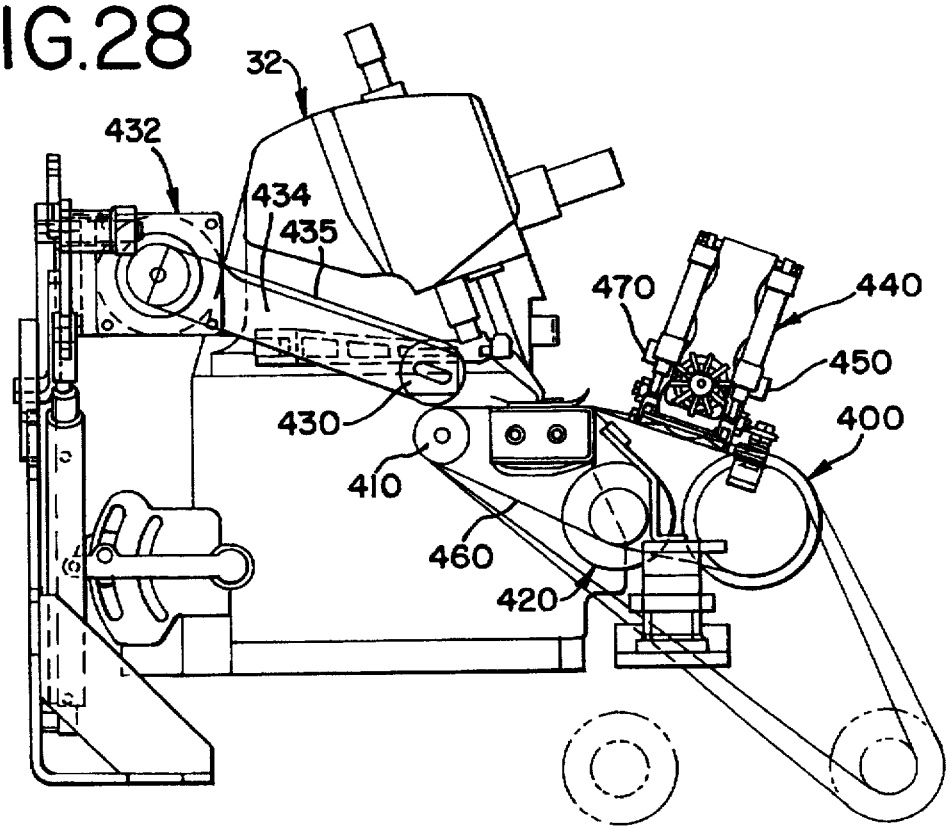
FIG. 28 is a front view of an embodiment of this invention for connecting neck bands to shirt bodies.
Figure 29:
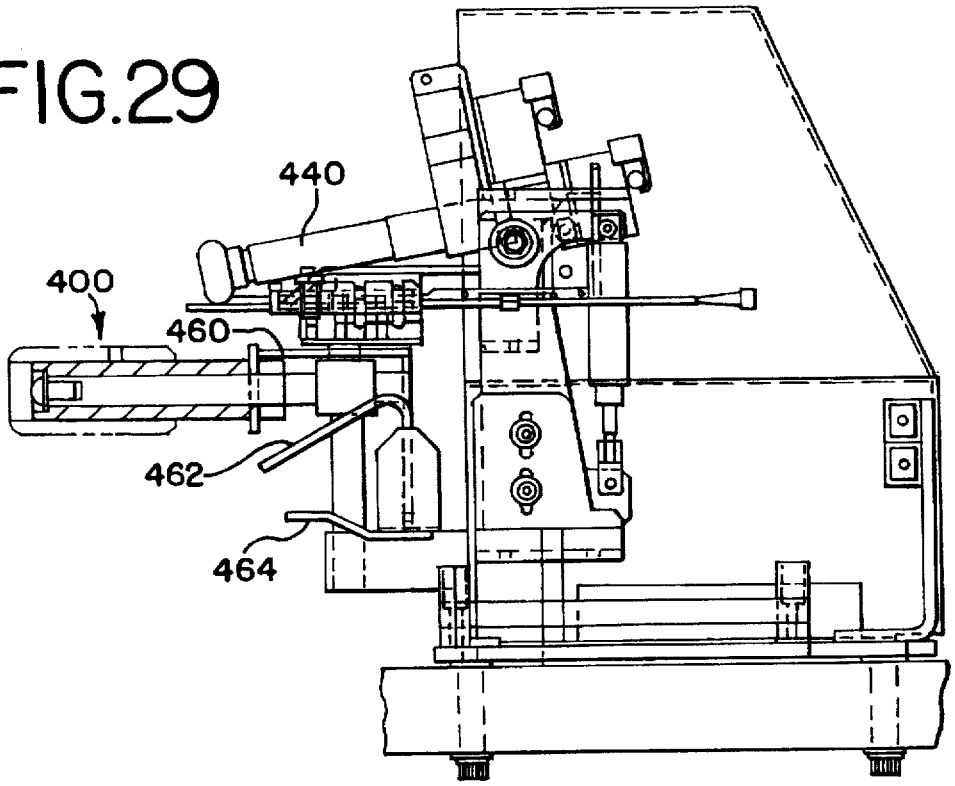
FIG. 29 is a side view of the machine shown in FIG. 28.
Figure 30:
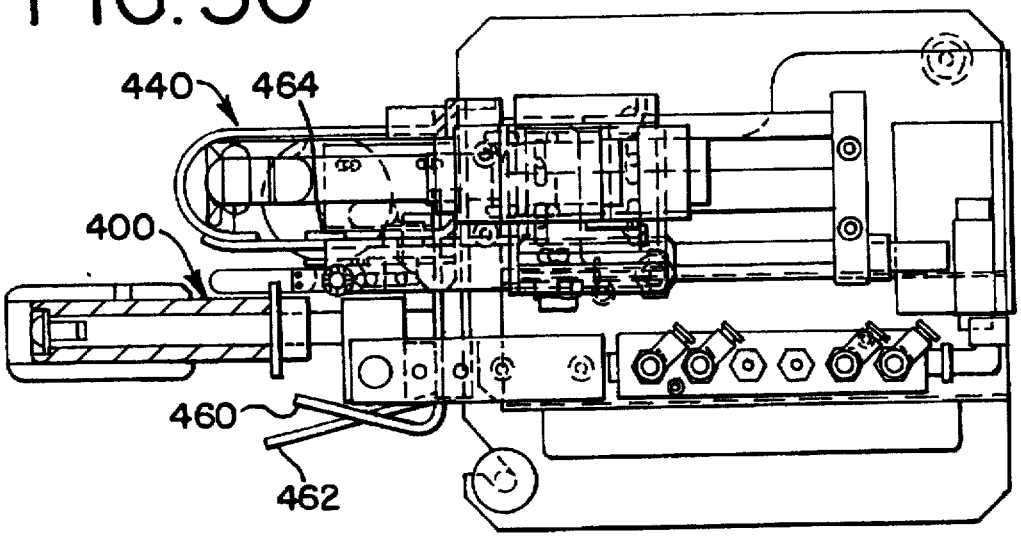
FIG. 30 is a plan view of the machine shown in FIG. 28.

FIG. 28 shows a sewing machine 32 that is used to attach neck bands to the circular opening formed in shirt bodies. This sewing machine is the same machine previously discussed and includes the same stitch forming instruments.

Figure 31:
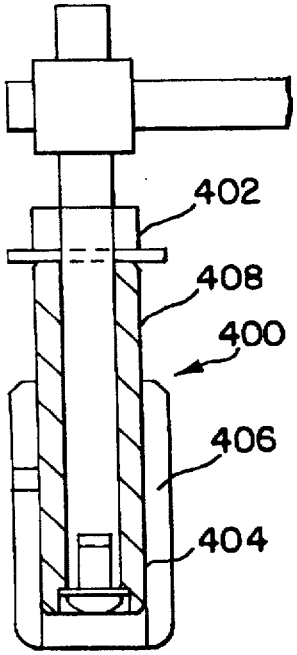
FIG. 31 is a plan view of the stationary roller.

A stationary roller 400, see FIG. 31, is mounted to the sewing machine frame 30 such that roller 400 is free to rotate. Roller 400 extends along a longitudinal axes and includes a mounting end 402 and a free end 404. A collar 406 is secured to the free end portion 404 which produces a shallow groove 408 adjacent the mounting end portion 402. The longitudinal axis extends transverse to a vertical plane that passes through the stitch line formed by the sewing machine 32.

Figure 32:
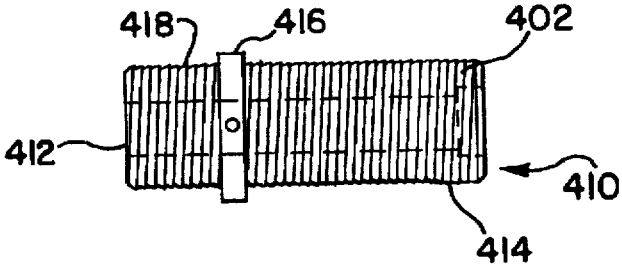
FIG. 32 is a plan view of the under puller roller.

An under puller roller 410, see FIG. 32, is mounted to the sewing machine frame 30 such that roller 410 is free to rotate. Roller 410 extends along a longitudinal axes and includes a mounting end 412 and a free end 414. A collar 416 is secured to the roller which produces a shallow groove 418 adjacent the mounting end portion 412. The longitudinal axis extends transverse to a vertical plane that passes through the stitch line formed by the sewing machine 32.

Figure 33:
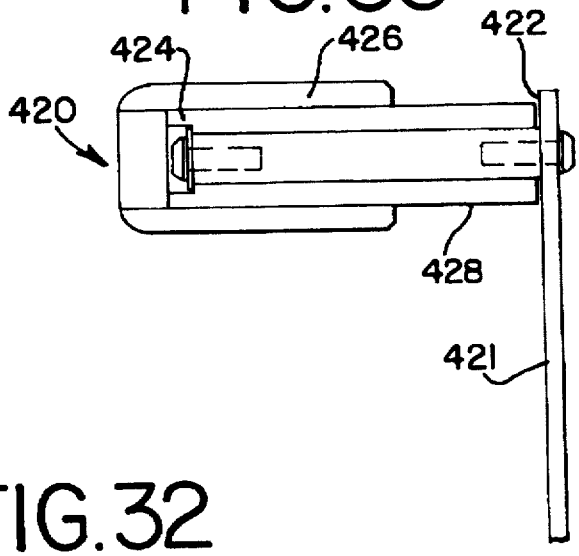
FIG. 33 is a plan view of the tension roller.
Figure 36:
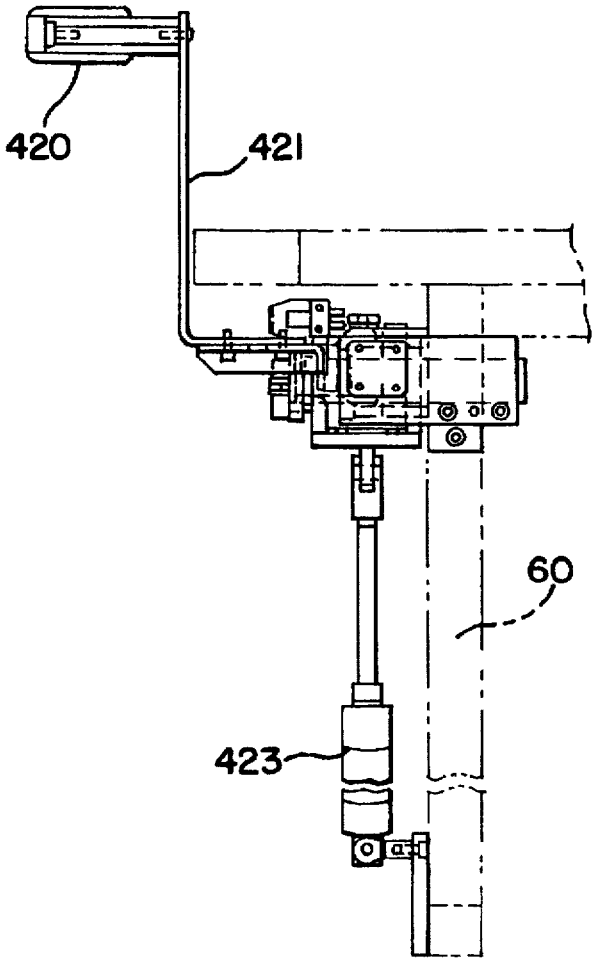
FIG. 36 is a separate side view of the tension roller including the actuation mechanism therefor.

A tension or moving roller 420, see FIG. 33, is mounted on an arm 421. As best seen in FIG. 36 arm 421 is pivotally mounted on the sewing machine frame 30. An air cylinder 423 is provided for pivoting arm 421 relative to the frame 30. In FIG. 28, roller 420 is shown in its collar load position which is its upper most position between stationary roller 400 and under puller roller 410, an intermediate position below its collar load position and a sew position which is below and to the right of the collar load position. Roller 420 is free to rotate relative to arm 421. Roller 420 extends along a longitudinal axes and includes a mounting end 422 and a free end 424. A collar 426 is secured to the roller which produces a shallow groove 418 adjacent the mounting end portion 422. The longitudinal axis extends transverse to a vertical plane that passes through the stitch line formed by the sewing machine 32.

A puller 430 carried at the free end of a pivot arm 434 is driven through a belt 435 by a stepper motor 432. Puller 430 extends along a longitudinal axes and can be pivoted into a drive position, illustrated in FIG. 28, at which it is adjacent under puller roller 410. The puller 430 can be pivoted away from the drive position illustrated in FIG. 28 to a workpiece load position at which it is spaced away from the under puller roller 410.

An edge guide device 440, of the type fully discussed above with reference to FIGS. 11 and 12, is mounted on the frame 30 between the stationary roller 400 and the collar load position of the movable roller 410. The edge guide device 440 is mounted such that the feeding wheel 13 can be pivoted up and away from the workpiece and the entire edge guide device 440 can be shifted transverse to the direction of feed of the workpiece. A material presence sensor 470 is provided adjacent the edge guide device 440 to sense the presence of the collar band. An edge guide sensor mechanism 450 is provide adjacent the edge guide device 440. A reflective surface is provided at this point and when the reflective surface is not covered by the workpiece the ray from the sensor is reflected back to the sensor.

Figure 34:
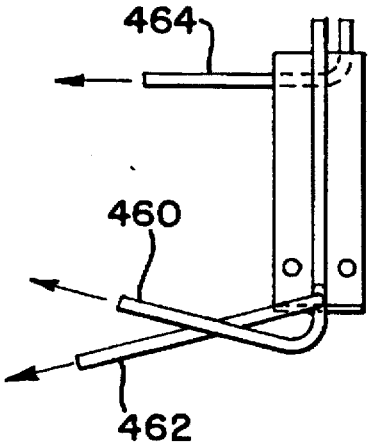
FIG. 34 is a separate top view of the blower tubes.
Figure 35:
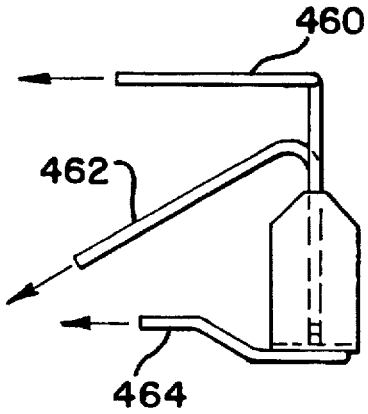
FIG. 35 is a separate side view of the blower tubes.

A top 460, middle 462 and bottom 464 blower tubes are provided through which jets of air, under pressure, flow in the direction of the arrows seen in FIGS. 34 and 35. The air jets impinge on the shirt body as it is being sewn and urging it away from the rotating mechanism and preventing the workpiece from becoming tangled.

The operation of the embodiment of the invention that has been illustrated in FIGS. 28 through 36 will now be discussed.

At the start of the operation the movable roller 420 is at its upper most or load position as illustrated in FIG. 28. At this time the puller 430 is pivoted away from the under puller roller 410.

The operator grasps a pre-cut cylindrical band of material, which is a tubular piece of rib knit material. The operator folds the tubular piece of material upon itself such that its two marginal edges are adjacent to each other. The operator places the folded band of material over the free ends of rollers 400 410 and 420, with the marginal ends first such that the folded band lies in the shallow grooves 408, 418 and 428 respectively. The grooves 408, 418 and 428 are dimensioned such that the folded collar band fits snugly therein. The path of the folded collar band as it has been placed on the rollers is indicated in FIG. 28 as 460. The collar band is sensed by the material presence sensor 470. The presence of the collar band causes the ply separator plate 143 of the edge guide sensor 440 to be shifted into operative position above the collar band. The neck opening of the shirt body is then loaded over the rollers 400, 410 and 420 and its marginal edge is placed over the marginal edges of the collar band. The edge of the shirt body is placed over the upper surface of the ply separator plate 143. The movable roller 420 then moves through its intermediate position to its sew position and the feeding wheel 13 of the edge guide device drops down on the surface of the shirt body. The sew sequence is then automatically started. As sewing progresses the edge of the shirt body is controlled by the action of the edge guide device 440 and the marginal edges of the shirt collar are controlled by the collars of their shallow grooves 408, 418 and 428. When the beginning of the seam progress to the point where it is sensed by the seam sensor, sewing is stopped and the edge guide device is retracted from between the plies and shifted away from the workpiece. This is necessary because the ply separator plate 143 is located between the shirt body and the collar band which is being sewn together. The edge guide device is shifted back to the workpiece with the separator plate now below the collar band and sewing is again started. The edge guider controls the garment for the end of sew blend. The garment is oversewn, fed away from the knife and the chain is cut. The moving roller returns to its load position thus releasing tension of the sewn shirt collar, the stacker tray is extended and the finished garment is ejected and falls to the stacker tray. The stacker tray is then shifted away from the sew station.

All of the parameters such as speeds, delay periods, time periods, stitch counts and encoder pulse numbers that go into the timing diagram can be changed and are programmable through the microprocessor control panel 52. This is a very important feature of this machine since it allows the machine to be used for all sizes and numerous styles of apparel.

While the invention has heretofore been described in detail with particular reference to illustrated apparatus, it is to be understood that variations, modifications and the use of equivalent mechanisms can be effected without departing from the scope of this invention. It is, therefore, intended that such changes and modifications be covered by the following claims.

What is claimed is:

1. A sewing machine having components including a needle, presser foot, feed dog, throat plate and a drive motor with attachments including an edge guider, a sensor, a stationary roller and an under puller roller, in combination with a processor that automatically controls said components and attachments, said sewing machine including stitch forming instruments for forming a seam having a stitch line a predetermined distance from the aligned marginal edges of a plurality of layers of tubular workpieces, a frame, said sewing machine mounted on said frame, a workpiece control and advancing mechanism mounted on said frame, said workpiece control and advancing mechanism functioning to individually control each workpiece layer such that its marginal edge is maintained said predetermined distance from said stitch line as the tubular workpiece advances toward said stitch forming instruments, said workpiece control and advancing mechanism comprising:

said stationary roller and said under puller roller having longitudinal axes, mounting ends and free ends;

said stationary roller and said under puller roller mounted on said frame at their mounting ends such that their longitudinal axes extend transverse to a vertical plane passing through said stitch line;

a puller mounted on said frame by a processor controlled mounting mechanism that can move said puller from a drive position adjacent said under puller roller to an inoperative position away from said under puller roller, and a drive mechanism on said frame for imparting rotary drive to said puller;

a processor controlled mounting structure for mounting said edge guider on said frame and moving said edge guider from an operating location along said stitch line between said stationary roller and said under puller roller and a non operating position away from said stitch line, an edge sensor that cooperates with said edge guider, said edge sensor sends a signal to said processor whenever it changes from sensing an edge to not sensing an edge or from not sensing an edge to sensing an edge, and said processor sends a signal to the edge guider to reverse its direction of feed in response to the signal from the sensor;

a mechanism for retracting said edge guider from its operating position to its non operating position when a beginning seam edge approaches said stitch forming instruments and returning said edge guide to its operating position under said plurality of layers of tubular workpieces; and a seam detector for detecting said seam as it approaches said edge guider and transmitting a signal to said processor indicating the location of the seamed edge, said processor, in response to receiving this signal from said seam detector, sends a signal that activates said mechanism for retracting said edge guider before the seam reach the edge guider.

2. The invention as set forth in claim 1 wherein said workpiece control and advancing mechanism further comprises:

a moving roller having a longitudinal axis, a mounting end and a free end;

said moving roller mounted on said frame at its mounting end through mechanism controlled by said processor that will cause said moving roller to move from a loading position to a sewing position, said moving roller loading position being between said stationary roller and said under puller roller, said moving roller sewing position being below said stationary roller and said under puller roller.

3. The invention as set forth in claim 2 wherein said workpiece control and advancing mechanism further comprises:

said stationary roller, moving roller and under puller roller each including, aligned, collar portions, that divide said rollers into first longitudinal extending sections that are adjacent their mounting ends and second longitudinal extending sections that are adjacent their free ends.

4. The invention as set forth in claim 3 wherein said workpiece control and advancing mechanism further comprises: the diameters of said first longitudinal extending sections of said stationary and under puller rollers being smaller than their second longitudinal extending sections.

5. A sewing machine, of the type having components that include a needle, presser foot, feed dog, throat plate and a drive motor that is equipped with attachments including an edge guider, a sensor, and workpiece control rollers, for attaching a two layered cylindrical band workpiece having two marginal edges to a single layered workpiece having a circular opening defined by a marginal edge;

a microprocessor controller connected to said sewing machine to automatically monitor and control the sewing machine components and attachments;

said sewing machine including stitch forming instruments for forming a seam having a stitch line a predetermined distance from the aligned marginal edges of said workpieces;

a frame;

said sewing machine mounted on said frame;

a workpiece control and advancing mechanism mounted on said frame, said workpiece control and advancing mechanism functioning to individually control each workpiece layer such that its marginal edge is maintained said predetermined distance from said stitch line as said workpieces move in the direction toward said stitch forming instruments, said workpiece control and advancing mechanism comprising:

said workpiece control rollers including a stationary roller and an under puller roller, said stationary roller and said under puller roller having longitudinal axes, mounting ends and free ends;

said stationary roller and said under puller roller mounted on said frame at their mounting ends such that their longitudinal axes extend transverse to a vertical plane passing through said stitch line;

a puller mounted on said frame by a microprocessor controlled mounting mechanism that can move said puller from a drive position adjacent said under puller roller to an inoperative position away from said under puller roller, and a drive mechanism on said frame for imparting rotary drive to said puller;

a microprocessor controlled mounting structure for mounting said edge guider on said frame and moving said edge guider from an operating location along said stitch line between said stationary roller and said under puller roller and a non operating position away from said stitch line, an edge sensor that cooperates with said edge guider, said edge sensor sends a signal to said microprocessor whenever it changes from sensing an edge to not sensing an edge or from not sensing an edge to sensing an edge, and said microprocessor sends a signal to the edge guider to reverse its direction of feed in response to the signal from the sensor;

a mechanism for retracting said edge guider from its operating position to its non operating position when a beginning seam edge approaches said stitch forming instruments and returning said edge guide to its operating position under said plurality of layers of tubular workpieces; and a seam detector for detecting said seam as it approaches said edge guider and transmitting a signal to said microprocessor indicating the location of the seam, said microprocessor, in response to receiving this signal from said seam detector, sends a signal that activates said mechanism for retracting said edge guider before the seam reach the edge guider.

6. The invention as set forth in claim 5 wherein said workpiece control and advancing mechanism further comprises:

a moving roller having a longitudinal axis, a mounting end and a free end;

said moving roller mounted on said frame at its mounting end through a mechanism controlled by said microprocessor that will cause said moving roller to move from a loading position to a sewing position, said moving roller loading position being between said stationary roller and said under puller roller, said moving roller sewing position being below said stationary roller and said under puller roller.

7. The invention as set forth in claim 6 wherein said workpiece control and advancing mechanism further comprises:

said stationary roller, moving roller and under puller roller each including, aligned, collar portions that divide said rollers into first longitudinal extending sections that are adjacent their mounting ends and second longitudinal extending sections that are adjacent their free ends.

8. The invention as set forth in claim 7 wherein said workpiece control and advancing mechanism further comprises: the diameters of said first longitudinal extending sections of said stationary and under puller rollers being smaller than their second longitudinal extending sections.

9. The invention as set forth in claim 5 wherein said sewing machine includes an encoder that transmits a pulse to said microprocessor for each stitch produced by the sewing machine and said microprocessor uses this stitch pulse to synchronize the speed of said edge guider with the speed of the sewing machine.

10. A sewing machine, of the type having components that includes a needle, presser foot, feed dog, throat plate and a drive motor that is equipped with attachments including an edge guider, sensor, and workpiece control rollers, in combination with a processor that automatically controls its components and attachments, said sewing machine including stitch forming instruments for forming a seam having a stitch line a predetermined distance from the aligned marginal edges of a plurality of layers of tubular workpieces, a frame, said sewing machine mounted on said frame, workpiece control and advancing mechanism mounted on said frame, said workpiece control and advancing mechanism functioning to individually control each workpiece layer such that its marginal edge is maintained said predetermined distance from said stitch line as the tubular workpiece advances toward said stitch forming instruments, said workpiece control and advancing mechanism comprising:

a stationary roller mounted on said frame, said stationary roller supports the tubular workpieces at a location in advance of said stitch forming instruments;

a tension roller that contacts said tubular workpieces at a location following said stitch forming instruments;

said tension roller being mounted on said frame such that it is movable toward and away from said stationary roller such that said tubular workpiece is loaded as a relaxed band on said stationary roller and said tension roller and then stretched to an expanded state when said tension roller is moved away from said stationary roller;

an edge guide member mounted on said frame along the stitch line between said stationary roller and said stitch forming instruments;

a mechanism for retracting said edge guide members from the stitch line as the seam approaches said stitch forming instruments;

a seam detector for detecting said seam as it approaches an edge guide member and transmitting a signal to said processor indicating the location of the seam;

said processor, in response to receiving the signal from said seam detector, sends a signal that activates said mechanism for retracting said edge guide members before the seam reaches the edge guide members.

11. The invention as set forth in claim 10 wherein said workpiece control and advancing mechanism further comprises:

an under puller roller, said under puller roller has a longitudinal axis, a mounting end and a free end;

said stationary roller, moving roller and under puller roller each including, aligned, collar portions that divide said rollers into first longitudinal extending sections that are adjacent their mounting ends and second longitudinal extending sections that are adjacent their free ends.

12. The invention as set forth in claim 11 wherein said workpiece control and advancing mechanism further comprises: the diameters of said first longitudinal extending sections of said stationary and under puller rollers being smaller than their second longitudinal extending sections.

13. The invention as set forth in claim 10 wherein said sewing machine includes an encoder that transmits a pulse to said processor for each stitch produced by the sewing machine and said processor uses this stitch pulse to synchronize the speed of said edge guider with the speed of the sewing machine.

14. The method of attaching a two layered cylindrical band workpiece having two marginal edges to a single layered workpiece having a circular opening defined by a marginal edge along a stitch line using a sewing machine having stitch forming instruments comprising the steps of:

(a). loading the cylindrical band onto workpiece control and advancing mechanisms;

(b). loading the workpiece having a circular opening over the cylindrical band;

(c). aligning the marginal edge of the workpiece having a circular opening such that it is parallel with and spaced a predetermined distance from the stitch line;

(d). expanding the cylindrical band and workpiece having a circular opening to a sew dimension;

(e). beginning a sew sequence;

(f). guiding the marginal edges of the workpiece having a circular opening during the sew sequence with an edge guider;

(g). sensing the sewn seam as it approaches the stitch forming instruments; and (h). withdrawing the edge guider from the stitch line so that the sewn seam may further approach the stitch forming instruments.

15. The method as set forth in claim 14 in which a stacker is provided for use in combination with the sewing machine and includes a stacker tray and wherein the following additional steps are performed:

(i). releasing the tension on the sewn waist band and shirt body;

(j). extending a stacker tray toward the sewing machine;

(k). ejecting the sewn workpiece from the sewing machine such that it is caught by the stacker tray; and (l). moving the stacker tray away from the sewing machine.

16. The method as set forth in claim 14 in which the following additional steps are performed:

(i). chaining off from the sewn workpiece;

(j). severing the chain from the workpiece; and (k). clearing the severed chain from the work area.

17. The method as set forth in claim 14 in which the additional steps are performed:

(i). aligning the marginal edges of the two layered cylindrical band workpiece with shoulders that confine the workpiece to grooves formed in the control and advancing rollers.

* * * * *